US006492972B1

(12) United States Patent
Kubota et al.

(10) Patent No.: US 6,492,972 B1
(45) Date of Patent: Dec. 10, 2002

(54) DATA SIGNAL LINE DRIVING CIRCUIT AND IMAGE DISPLAY APPARATUS

(75) Inventors: Yasushi Kubota, Sakurai (JP); Tamotsu Sakai, Tenri (JP); Hajime Washio, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/275,261

(22) Filed: Mar. 23, 1999

(30) Foreign Application Priority Data

Mar. 24, 1998 (JP) ..... 10-076349

(51) Int. Cl.[7] ..... G09G 3/36

(52) U.S. Cl. ..... 345/100; 345/98; 345/99; 345/100; 345/101; 345/102; 345/103; 345/104; 345/211; 345/213

(58) Field of Search ..... 345/98, 99, 100, 345/101, 102, 103, 104, 211, 213

(56) References Cited

U.S. PATENT DOCUMENTS 4,390,874 A * 6/1983 Woodside et al. ..... 340/812
5,610,414 A * 3/1997 Yoneda et al. ..... 257/99
5,682,175 A * 10/1997 Kitamura ..... 345/98
5,844,538 A * 12/1998 Shiraki et al. ..... 345/98
5,959,397 A * 9/1999 Koyanna et al. ..... 345/100
5,990,857 A * 11/1999 Kubota et al. ..... 345/98

FOREIGN PATENT DOCUMENTS

JP 7-311561 A 11/1995

* cited by examiner

*Primary Examiner*—Richard Hjerpe
*Assistant Examiner*—Jean Lesperance
(74) *Attorney, Agent, or Firm*—Nixon & Vanderhye P.C.

(57) ABSTRACT

A data signal line driving circuit which sequentially forms a plurality of sampling signals and continuously samples input signals to output such input signals, in response to the plurality of sampling signals, wherein the sampling signals respectively represent sampling periods thereof which are different from each other, and a pulse width of each of the sampling signals is prescribed to be small so that rising and falling of each of the sampling signals do not overlap each other.

24 Claims, 30 Drawing Sheets

DATA SIGNAL LINE DRIVING CIRCUIT AND IMAGE DISPLAY APPARATUS

BACKGROUND OF THE INVENTION

1. Field of the Invention

The present invention relates to a data signal line driving circuit for continuously sampling input signals and outputting them, and an image display apparatus which adopts the data signal line driving circuit.

2. Description of the Related Art

Hereinafter, a liquid crystal display apparatus and a data line driving circuit used therein will be described using conventional examples of an image display apparatus and a data signal line driving circuit.

An active matrix type liquid crystal display apparatus is well known. This apparatus is composed of a pixel array ARRAY, a scanning signal line driving circuit GD, and a data signal line driving circuit SD, as shown in FIG. 17.

The pixel array ARY includes scanning signal lines GL and data signal lines SL crossing the scanning signal lines GL. Each pixel PIX is provided in a matrix in each portion surrounded by two adjacent scanning signal lines GL and two adjacent data signal lines SL.

The data signal line driving circuit SD sequentially samples input video signals DAT in synchronization with a timing signal such as a clock signal $CLK_s$, and amplifies each sampled video signal, if required, to output it to each data signal line SL.

The scanning signal line driving circuit GD sequentially selects each scanning signal line GL in synchronization with a timing signal such as a clock signal $CLK_g$, and controls opening and closing of each switching element in each pixel PIX along the selected scanning signal line GL, there by writing each video signal (data) output to each data signal line SL into each pixel PIX and allowing data written into each pixel PIX to be held.

As shown in FIG. 18, each pixel PIX shown in FIG. 17 is composed of a field effect transistor SW which is a switching element and a pixel capacitance made of a liquid crystal capacitance CL and an auxiliary capacitance CS which is added if required.

As shown in FIG. 18, the data signal line SL is connected to one of electrodes of the pixel capacitance through a drain and a source of the transistor SW. A gate of the transistor SW is connected to the scanning signal electrode line GL, and the other electrode of the pixel capacitance is connected to a common electrode line of all the pixels. Due to a voltage applied to each liquid crystal capacitance CL, a transmittance or a reflectivity of liquid crystal is modulated, which contributes to a display.

Next, a method for sampling a video signal and outputting it to a data signal line will be described.

Examples of a method for driving a data signal line includes a dot sequential driving method and a line sequential driving method. Herein, only a dot sequential driving method will be described with reference to FIGS. 19 and 20. This description is also applicable to a line sequential driving method.

In each circuit shown in FIGS. 19 and 20, a shift register SR sequentially outputs sampling pulses while shifting them, in synchronization with a clock signal CLK (corresponding to the clock signal $CLK_s$ in FIG. 17). Sampling pulses $N_1$, $N_2$, $N_3$, and $N_4$ sequentially output from the shift register SR are sequentially supplied to respective analog switches $G_1$, $G_2$, $G_3$, and $G_4$. The analog switches $G_1$, $G_2$, $G_3$, and $G_4$ sequentially open in response to the respective sampling pulses $N_1$, $N_2$, $N_3$, and $N_4$, sequentially sampling video signals transmitted to a video signal line DAT, and sequentially outputting respective sampled video signals $SL_1$, $SL_2$, $SL_3$, and $SL_4$.

In the shift register SR, unit circuits as shown in FIG. 21 or 22 are arranged.

The unit circuit shown in FIG. 21 forms the shift register SR which shifts pulses only in one direction, and is composed of two clock control inverter circuits 201 and one inverter circuit 202.

The unit circuit shown in FIG. 22 forms the shift register SR which shifts pulses in both directions, and is composed of two clock control inverter circuits 201 and two inverter circuits 203.

Both the shift registers SR have a structure of a half-latch circuit, which latches a pulse only in one direction of a rising or falling of a clock signal and outputs a pulse width in one period of the clock signal.

In an example shown in FIG. 19, outputs of the shift register SR are directly used as the sampling pulses $N_1$ to $N_4$. Therefore, the continuous sampling pulses overlap each other by a half as shown in FIG. 23.

In an example shown in FIG. 20, respective overlapped portions of adjacent output pulses of the shift register SR are used as the sampling pulses $N_1$ to $N_4$. Therefore, the continuous sampling pulses do not overlap each other as shown in FIG. 24.

FIG. 25 shows an exemplary scanning signal line driving circuit. In this circuit, as shown in FIG. 27, a shift register SR sequentially outputs sampling pulses $N_1$ to $N_4$ while shifting them, in synchronization with a clock signal CLK corresponding to the clock signal $CLK_g$ in FIG. 17. This driving circuit is designed in such a manner that adjacent output pulses of the shift register SR do not overlap each other. Furthermore, by selecting an overlapped portion between the signal thus obtained and a pulse width control signal GPS from outside, each sampling pulse having a desired pulse width is obtained.

In the conventional data signal line driving circuits shown in FIGS. 19 and 20, every other sampling pulse, $N_1$ to $N_4$, partially overlaps with one another as shown in FIG. 23, and the continuous sampling pulses, $N_1$ to $N_4$, partially overlap each other as shown in FIG. 24. This is because, in the conventional circuit configuration, a sampling pulse rises when another sampling pulse falls. Furthermore, due to variation and the like in transistor characteristics in the circuit, a timing of a part of sampling pulses may be shifted. In this case, an overlapped portion of the respective sampling pulses becomes larger.

In the case where sampling pulses overlap each other, a level of a video signal to be written into a data signal line may be changed. For example, in the circuit shown in FIG. 20, when the subsequent sampling pulse $N_3$ rises before the sampling pulse $N_2$ is turned off as shown in FIG. 26, the video signal DAT is drawn to the data signal line $SL_3$ corresponding to the sampling pulse $N_3$ as well as the data signal line $SL_2$ corresponding to the sampling pulse $N_2$. Therefore, a level of the video signal DAT to be output to the data signal line $SL_2$ decreases by $\Delta$ V. Similarly, when the sampling pulse $N_4$ rises before the sampling pulse $N_2$ is turned off in the circuit shown in FIG. 19, the video signal DAT is drawn to two data signal lines $SL_2$ and $SL_4$. Therefore, a level of the video signal DAT to be output to the data signal line $SL_2$ decreases.

Consequently, a desired pixel potential cannot be obtained, making it difficult to obtain a normal display. In particular, when there is a variation in an overlapped portion of sampling pulses, level change values of a video signal and a pixel potential vary, which may cause roughness and a stripe pattern in an image.

The circuit shown in FIG. 25 has the following disadvantage: although a pulse width of each sampling pulse is adjusted, it is required to generate and supply the pulse width control signal GPS having a frequency twice that of the clock signal CLK; therefore, a burden on an external circuit is increased.

SUMMARY OF THE INVENTION

A data signal line driving circuit is provided, which sequentially forms a plurality of sampling signals and continuously samples input signals to output such input signals, in response to the plurality of sampling signals, wherein the sampling signals respectively represent sampling periods thereof which are different from each other, and a pulse width of each of the sampling signals is prescribed to be small so that rising and falling of each of the sampling signals do not overlap each other.

In one embodiment of the present invention, each of the sampling signals is obtained as a NAND signal or a NOR signal between a pulse signal and a signal obtained by delaying the pulse signal through a plurality of inverter circuits, whereby a pulse width of each of the sampling signals is prescribed to be small.

In another embodiment of the present invention, a capacitance is connected between the plurality of inverter circuits.

In another embodiment of the present invention, a capacitance is connected between each of the inverter circuits and either a NAND circuit or a NOR circuit.

In another embodiment of the present invention, a pulse signal is a pulse output from a shift register.

In another embodiment of the present invention, the above-mentioned data signal line driving circuit includes a shift register capable of shifting sampling pulses in both directions or in one direction, wherein each of the sampling signals is obtained by using either a NAND signal or a NOR signal between two adjacent output pulses output from the shift register, and a delay signal of the NAND signal or the NOR signal, whereby the sampling signal of either the NAND signal or the NOR signal, having a decreased pulse width, is obtained.

In another embodiment of the present invention, the above-mentioned data signal line driving circuit includes a shift register capable of shifting sampling pulses in one direction, wherein each of the sampling signals is obtained as either a NAND signal or a NOR signal between one of two adjacent output pulses output from the shift register and the other pulse which is delayed, whereby a pulse width of each of the sampling signals is decreased.

In another embodiment of the present invention, a time of the delay is about 10 nsec to about 100 nsec.

According to another aspect of the present invention, an active matrix type image display apparatus includes: a plurality of data signal lines arranged in a column direction: a plurality of scanning signal lines arranged in a row direction; a plurality of pixels arranged in a matrix surrounded by the data signal lines and the scanning signal lines; a data signal line driving circuit for supplying video data to the data signal lines; and a scanning signal line driving circuit for supplying a scanning signal to the scanning signal lines, wherein the data signal line driving circuit is a data signal line driving circuit which sequentially forms a plurality of sampling signals and continuously sampling input signals to output them, in response to the sampling signals, wherein the sampling signals respectively represent sampling periods thereof which are different from each other, and a pulse width of each of the sampling signals is prescribed to be small so that rising and falling of each of the sampling signals do not overlap each other.

In one embodiment of the present invention, the scanning signal line driving circuit and the data signal line driving circuit are formed on the same substrate with the pixels.

In another embodiment of the present invention, active elements included in the scanning signal line driving circuit, the data signal line driving circuit, and the pixels are polycrystalline silicon thin film transistors.

In another embodiment of the present invention, the active elements are formed on a glass substrate by a process at about 600° C. or lower.

Hereinafter, the function of the present invention will be described.

In the data signal line driving circuit of the present invention, a pulse width of each sampling signal is prescribed to be small so that the rising and falling of each sampling signal for sampling a video data signal do not overlap each other. In this structure, after a video signal is output to a data signal line, a video signal is output to the subsequent signal line. Thus, a video signal on a data signal line can be prevented from being drawn to another data signal line, and a video signal at a desired voltage level can be output to any data signal line.

In one embodiment, a NAND or a NOR between a pulse signal delayed by a plurality of inverter circuits and a pulse signal which is not delayed is obtained. In this structure, a pulse width of each sampling signal can be prescribed to be small without using a control signal from outside. Thus, a video signal at a desired voltage level can be written to a data signal line without burdening an external control circuit or the like.

In another embodiment, a capacitance is added between the inverter circuits, or between the inverter circuit and a circuit for obtaining either a NAND signal or a NOR signal. In this structure, by appropriately selecting a value of the above-mentioned capacitance, a pulse width can be controlled. Thus, a pulse width can be arbitrarily set so as not allow sampling pulses to overlap each other. Because of this, after a video signal is output to a data signal line, a video signal is output to the subsequent data signal line. This prevents a video signal on a data signal line from being drawn to another data signal line, and a video signal at a desired voltage level can be written to a data signal line.

In another embodiment, a pulse signal is an output signal from a shift register. In this structure, a sampling pulse is obtained by using two adjacent output pulses output from the shift register. These sampling pulses overlap each other by about a half, but every other sampling pulse does not overlap with one another (i.e., a sampling pulse falls completely, and then, a sampling pulse after the subsequent sampling pulse rises). Thus, a video signal on a data signal line is prevented from being drawn to another data signal line, and a video signal at a desired voltage level can be written to a data signal line.

In another embodiment, a shift register is capable of shifting sampling pulses in both directions, and by using a NAND signal (or a NOR signal) between two adjacent output pulses output from the shift register, and a delay signal thereof, a pulse width of the NAND signal (or the NOR signal) is prescribed to be small. In this structure, after a sampling pulse falls completely, the subsequent sampling pulse rises, so that adjacent sampling pulses do not overlap each other. Therefore, a video signal on a data signal line is prevented from being drawn to another data signal line, and a video signal at a desired voltage level can be written to a data signal line. Furthermore, adjacent sampling pulses do not overlap each other, so that only one data signal line is connected to a video signal line at a time during driving. Thus, a capacitance load on a video signal line can be decreased compared with that in the above-mentioned structure, and the burden on an external video signal source can be alleviated and writing performance of a data signal line driving circuit itself can be enhanced. This structure is applicable to a shift register capable of shifting sampling pulses only in one direction.

In another embodiment, a shift register is capable of shifting sampling pulses in one direction, and by generating a NAND signal (or a NOR signal) between one of two adjacent output pulses output from the shift register and a delay signal of the other output pulse, a pulse width of the NAND signal (or a NOR signal) is prescribed to be small. In this structure, after a sampling pulse falls completely, the subsequent sampling pulse rises in the same way as in the above-mentioned structure. Therefore, fluctuation of a video signal (which is caused when the video signal is drawn to the subsequent data signal line) does not affect the previous data signal line, and a video signal at a desired voltage level can be written to a data signal line.

Furthermore, in the same way as in the aforementioned structure, adjacent sampling pulses do not overlap each other. Therefore, only one data signal line is connected to a video signal line at a time during driving. Thus, a capacitance load on a video signal line can be decreased, compared with that of the above-mentioned structure. This can alleviate a burden on an external video signal source and enhance driving ability of a data signal line driving circuit itself.

Furthermore, compared with the above-mentioned structure, a circuit which generates a NAND signal (or a NOR signal) between two adjacent output pulses output from the shift register is eliminated. Thus, in the case where a scanning direction of the shift register is limited to one direction, circuit configuration can be simplified, and miniaturization of a driving circuit, reduction in a production cost, and enhancement of a production yield can be expected.

In another embodiment, the time of a delay is about 10 nsec to about 100 nsec.

A timing shift of sampling pulses caused by rising characteristics of sampling pulses and a variation in transistor characteristics are on the order of about 10 nsec. Therefore, by setting the delay time at about 10 to about 50 nsec and decreasing the sampling pulse width, fluctuation of a video signal (which is caused when the video signal is drawn to the subsequent data signal line) does not affect the previous data signal line, making it possible to write a video signal at a desired voltage level to a data signal line.

Furthermore, the image display apparatus of the present invention is provided with the above-mentioned data signal line driving circuit.

Thus, as described above, in the data signal line driving circuit, fluctuation of a video signal (which is caused when the video signal is drawn to the subsequent data signal line) does not affect the previous data signal line, and a video signal at a desired voltage level can be written to a data signal line. Therefore, a video signal at a desired voltage level can also be written to a display electrode, and an image with high display quality can be displayed.

In one embodiment, the scanning signal line driving circuit and the data signal line driving circuit are formed on the same substrate with the pixels. In this structure, the pixels for performing a display, the data signal line driving circuit and the scanning signal line driving circuit for driving the pixels can be produced on the same substrate during the same step. Therefore, the production cost and mounting cost can be reduced, and the ratio of mounting satisfactory products can be enhanced.

In another embodiment, at least the pixels and the data signal line driving circuit are disposed on a polycrystalline silicon thin film formed on an insulating substrate.

When transistors are formed of polycrystalline silicon thin films as described above, high characteristics of driving force can be obtained, compared with the case of amorphous silicon thin film transistors used in a conventional active matrix liquid crystal display apparatus. Therefore, the pixels and the signal line driving circuit can easily be formed on the same substrate.

In another embodiment, the active elements are formed on a glass substrate by a process at about 600° C. or lower.

As described above, in the case where polycrystalline silicon thin film transistors are produced at about 600° C. or lower, it is possible to use an inexpensive glass substrate which has a low strain temperature but permits the apparatus to be large. Therefore, a large image display apparatus can be produced at a low cost.

Thus, the invention described herein makes possible the advantages of: (1) providing a data signal line driving circuit which is capable of enhancing display quality in an image display apparatus by preventing sampling pulses from overlapping each other; and (2) providing an image display apparatus which adopts the data signal line driving circuit.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative embodiments with reference to the drawings.

Embodiment 1

Figure 1:
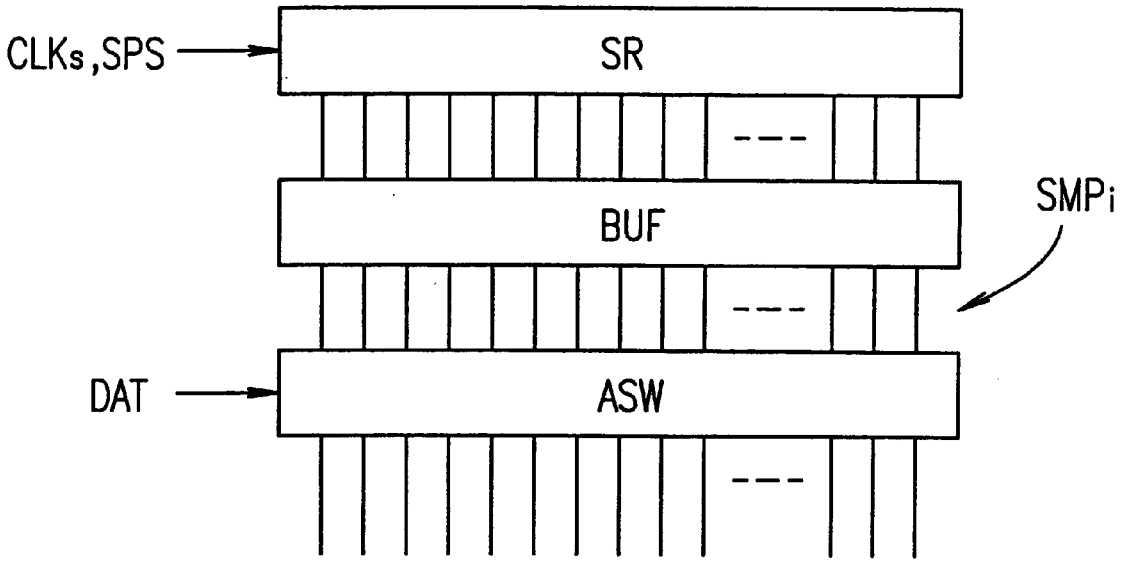
FIG. 1 is a block diagram showing a data signal line driving circuit in Embodiment 1 of the present invention.
Figure 2:
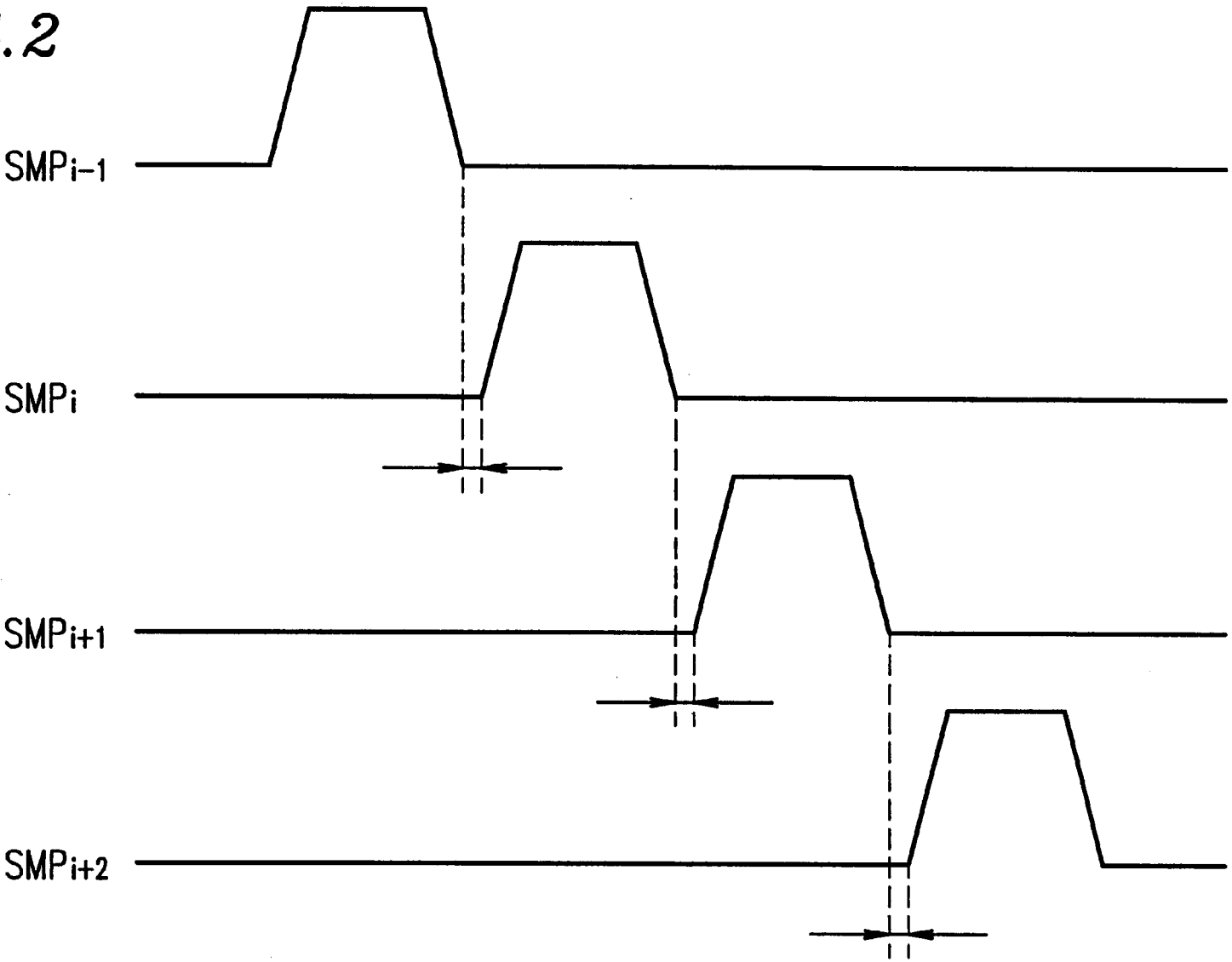
FIG. 2 is a diagram showing exemplary signal waveforms in the data signal line driving circuit shown in FIG. 1.
Figure 3:
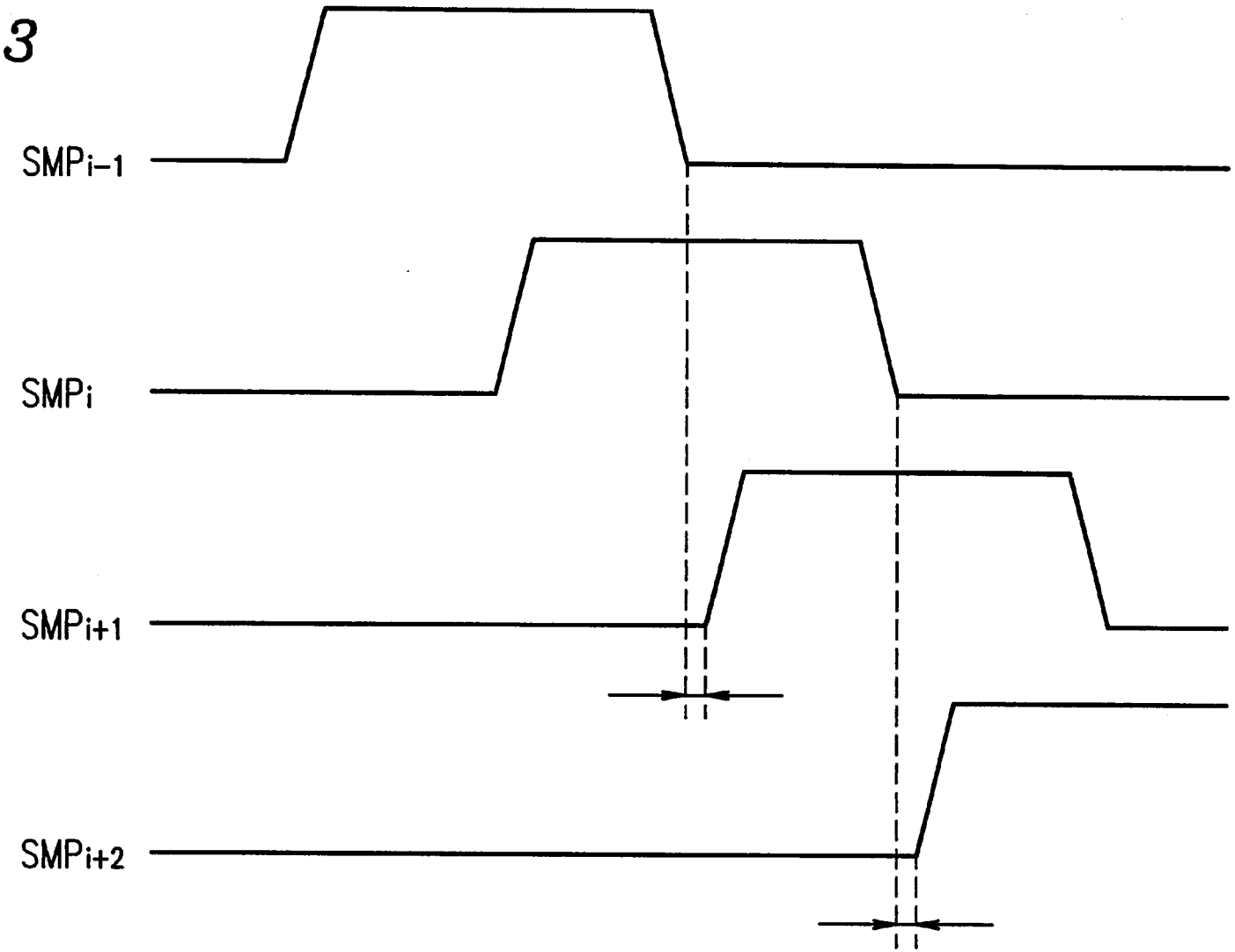
FIG. 3 is a diagram showing alternative exemplary signal waveforms in the data signal line driving circuit shown in FIG. 1.

FIG. 1 is a block diagram showing a data signal line driving circuit in Embodiment 1 of the present invention. FIGS. 2 and 3 illustrate waveforms of each signal in the data signal line driving circuit in the present embodiment.

In FIG. 1, a shift register SR receives a clock signal $CLK_s$ and a start signal SPS, and sequentially outputs pulses in synchronization with the clock signal $CLK_s$. A buffer BUF logically processes and amplifies the pulses, and sequentially generates and outputs sampling pulses $SMP_i$, $SMP_{i+1}$, . . . A sampling circuit ASW sequentially samples and outputs a video signal DAT in response to each sampling pulse.

As shown in FIG. 2, the buffer BUF sequentially generates the sampling pulses $SMP_i$, $SMP_{i+1}$, . . . in such a manner that adjacent sampling pulses do not overlap each other.

Alternatively, as shown in FIG. 3, the buffer BUF sequentially generates the sampling pulses $SMP_i$, $SMP_{i+1}$, . . . in such a manner that adjacent sampling pulses overlap each other by about a half of a pulse width and every other sampling pulse does not overlap with one another.

If the analog switch ASW sequentially samples and outputs the video signal DAT in response to the sampling pulses $SMP_i$, $SMP_{i+1}$, . . . , a sampled video signal is output to a data signal line, and then a sampled video signal is output to the subsequent data signal line. Therefore, a video signal to be output to one data signal line will not be drawn to another data signal line. Because of this, a video signal at a desired voltage level can be output to a data signal line, preventing the video signal from fluctuating by being drawn to another data signal line.

Figure 4A:
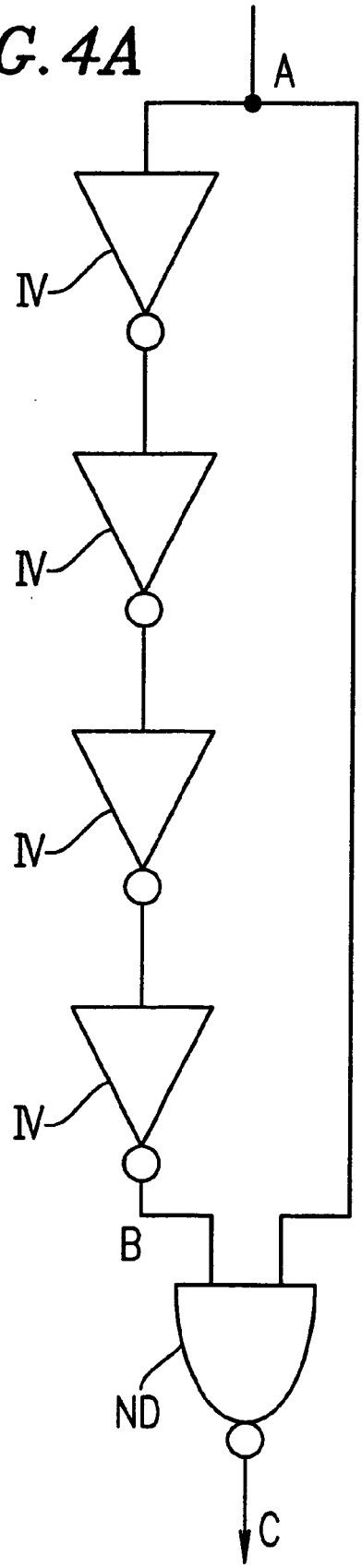
FIG. 4A is a block diagram showing a buffer in the data signal line driving circuit shown in FIG. 1.
Figure 4B:
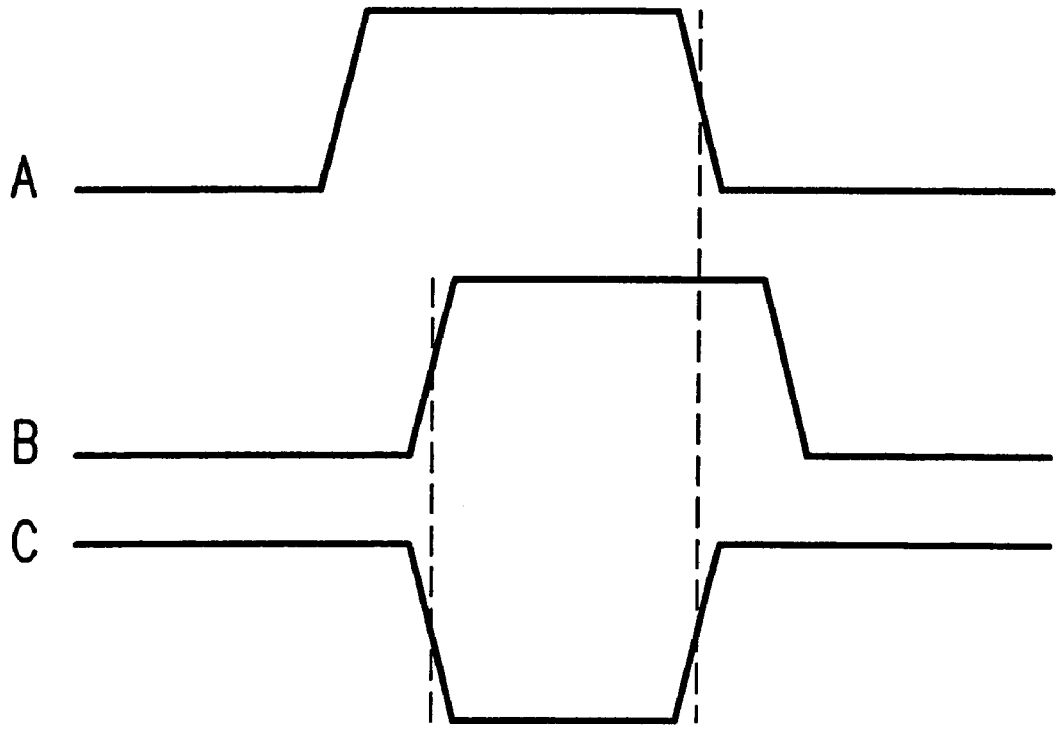
FIG. 4B is a diagram showing waveforms of sampling pulses formed by the buffer shown in FIG. 4A.
Figure 5A:
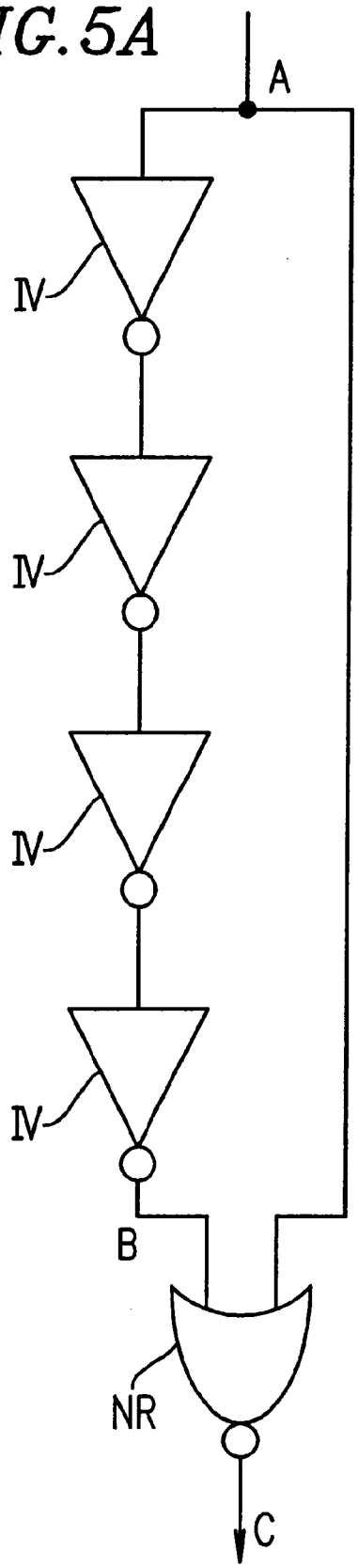
FIG. 5A is a block diagram showing another buffer in the data signal line driving circuit shown in FIG. 1.
Figure 5B:
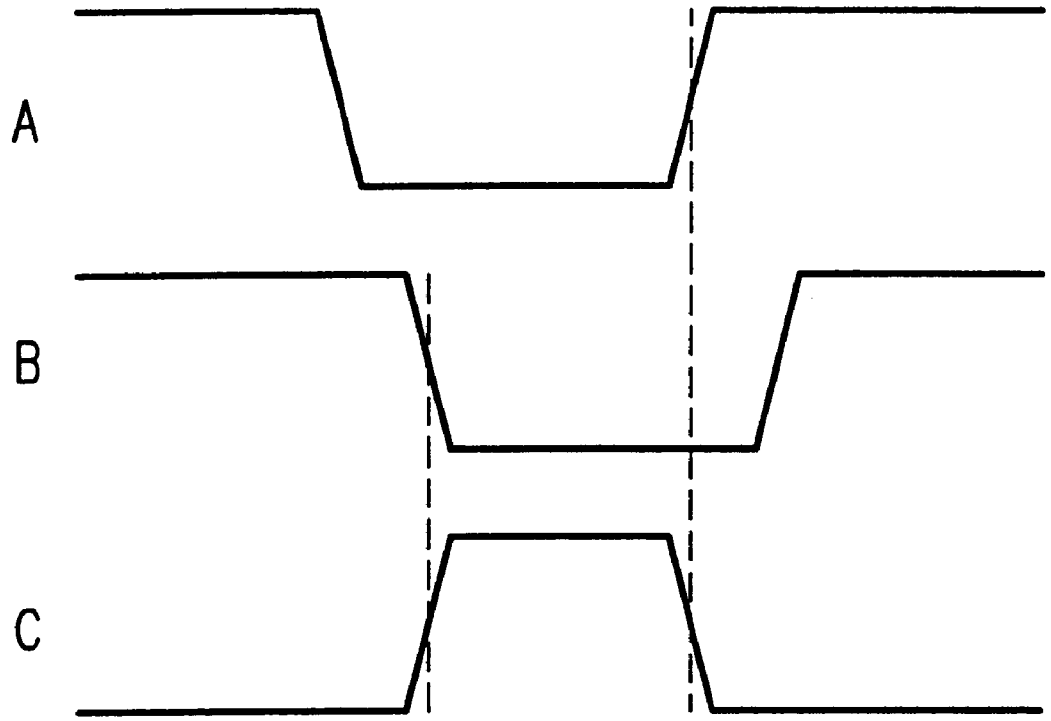
FIG. 5B is a diagram showing waveforms of sampling pulses formed by the buffer shown in FIG. 5A.

FIGS. 4A and 5A respectively show a part of an internal structure of the buffer BUF shown in FIG. 1. FIGS. 4B and 5B show waveforms of sampling pulses formed by the circuits shown in FIGS. 4A and 5A.

In FIG. 4A, a NAND circuit ND generates a NAND signal C between an input signal A and a delay signal B. which is obtained by delaying the input signal A through four-staged inverters IV.

As shown in FIG. 4B, a pulse width of the NAND signal C becomes smaller than that of the input signal A by a delayed portion of the delay signal B.

Thus, if the buffer circuit shown in FIG. 4A is used, each sampling pulse with a pulse width smaller than that of a pulse output from the shift register SR can be generated.

In FIG. 5A, a NOR circuit NR generates a NOR signal C between an input signal A and a delay signal B which is obtained by delaying the input signal A through four-staged inverters IV.

As shown in FIG. 5B, a pulse width of the output signal C becomes smaller than that of the input signal A by a delayed portion of the delay signal B.

Thus, in the same way as in the buffer circuit shown in FIG. 4A, if the buffer circuit shown in FIG. 5A is used, each sampling pulse which has a width smaller than that of a pulse output from the shift register SR can be generated.

The circuit configurations shown in FIGS. 4A and 5A are appropriately used in accordance with whether or not the output pulse of the shift register SR is a positive logic or a negative logic.

Figure 6A:
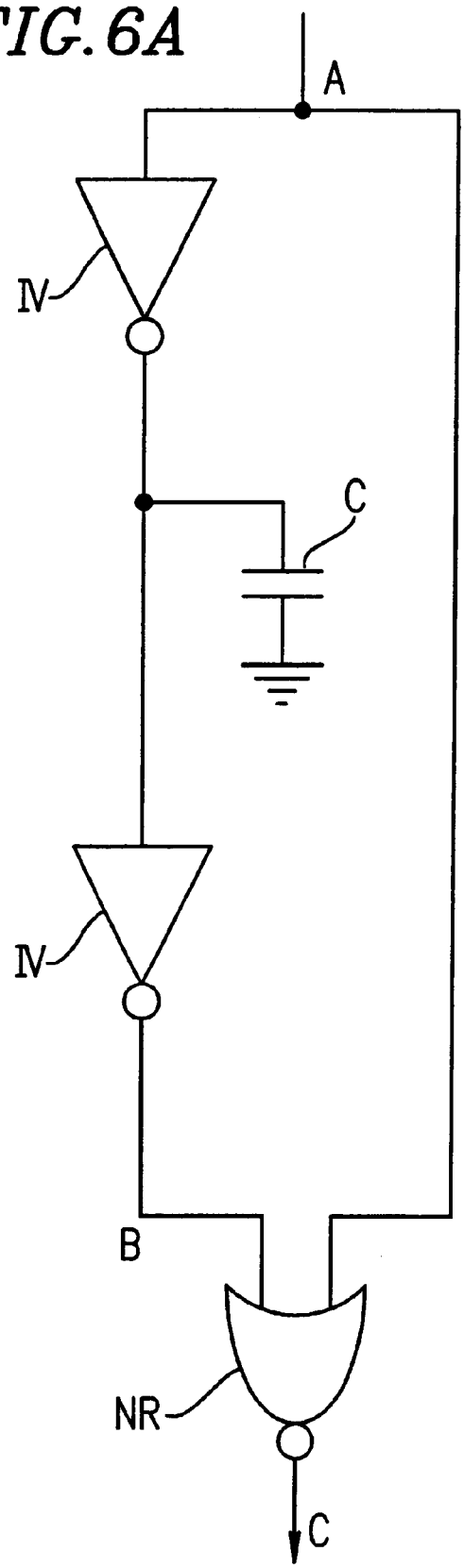
FIG. 6A is a block diagram showing still another buffer in the data signal line driving circuit shown in FIG. 1.
Figure 6B:
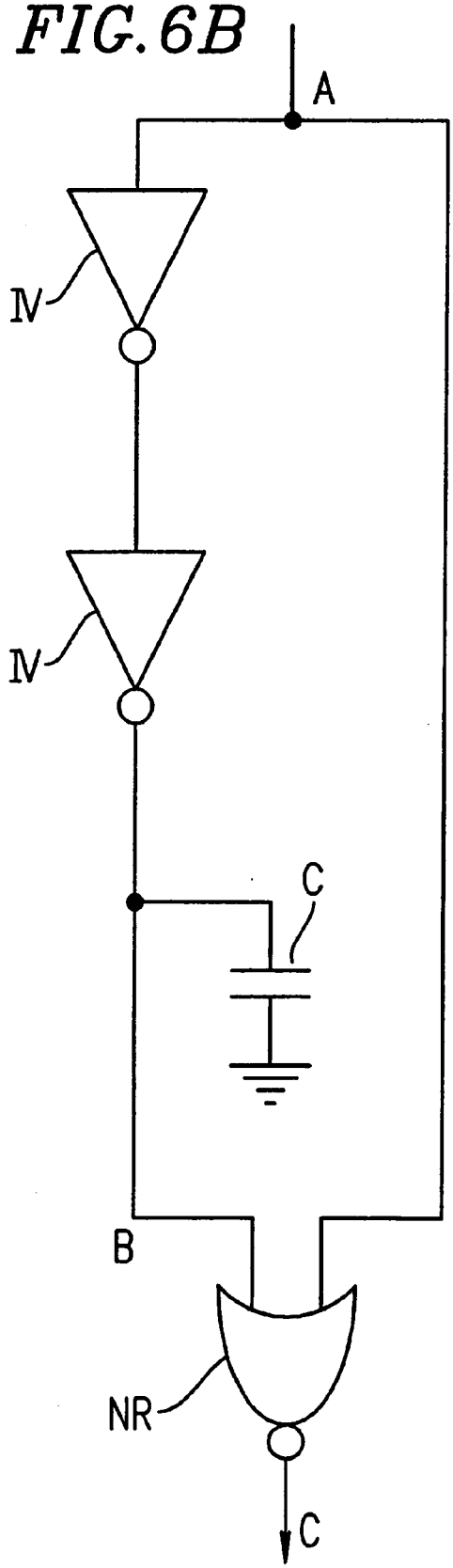
FIG. 6B is a block diagram showing yet another buffer in the data signal line driving circuit shown in FIG. 1.

FIGS. 6A and 6B respectively show a part of another internal structure of the buffer BUF shown in FIG. 1.

In FIG. 6A, a capacitance C is connected between two-staged inverters IV which delay the input signal A. Furthermore, in FIG. 6B, a capacitance C is added after two-staged inverters IV which delay the input signal A.

In any of these circuits, the capacitance C has a function of increasing a delay time. By adjusting the level of the capacitance C, the delay time can be set at a desired value.

Thus, by constructing the buffer BUF as shown in FIGS. 6A and 6B, a sampling pulse which has a pulse width smaller than that of an output pulse of the shift register SR can be generated.

Figure 7:
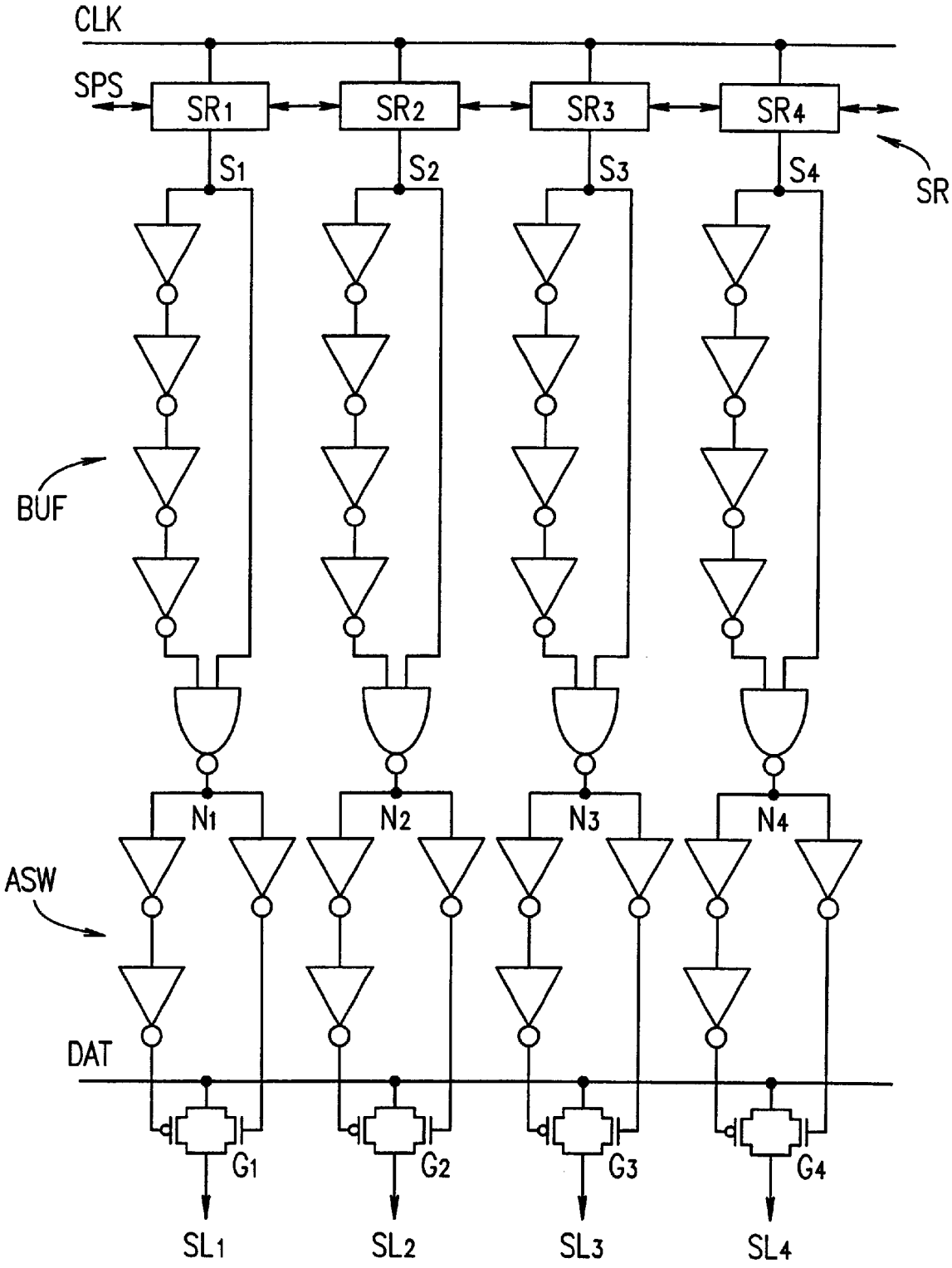
FIG. 7 is a block diagram showing a detailed structure of the data signal line driving circuit shown in FIG. 1.

FIG. 7 is a block diagram showing a detailed structure of the data signal line driving circuit shown in FIG. 1. In FIG.

Figure 21:
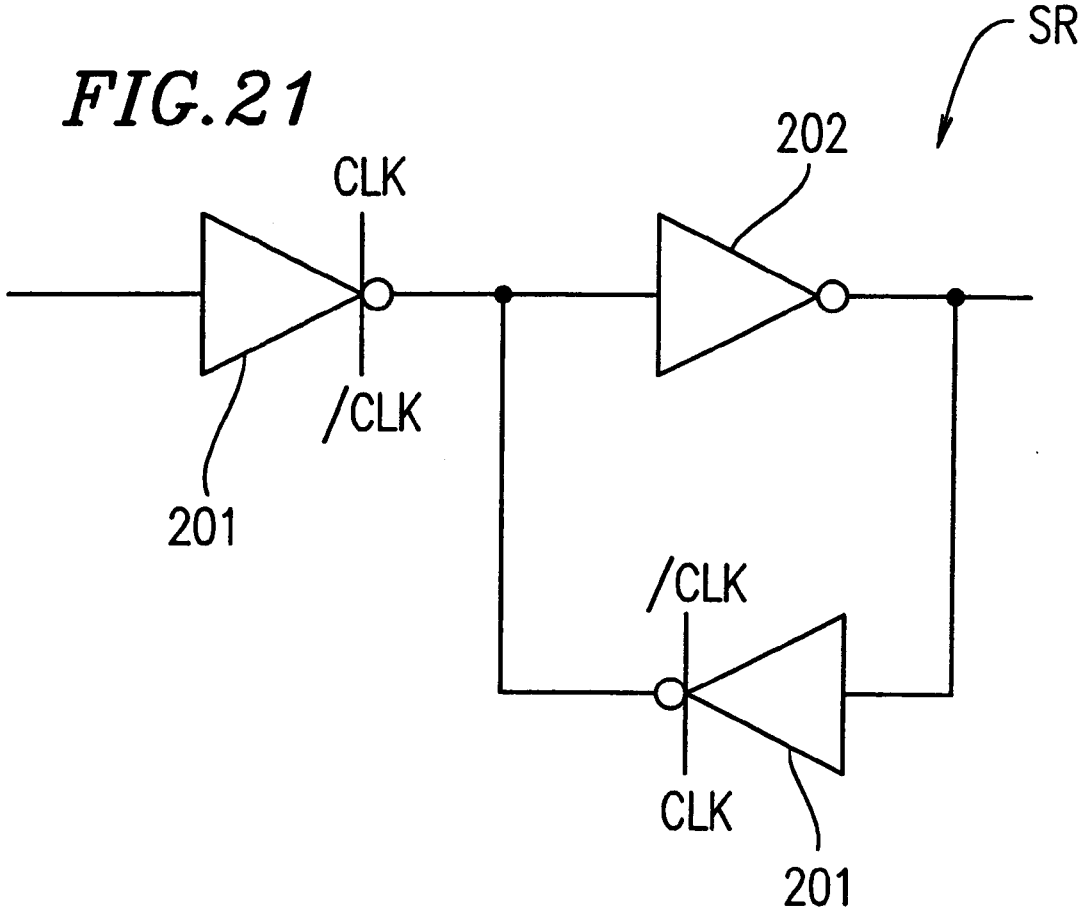
FIG. 21 is a circuit diagram showing an exemplary structure of a shift register used in a data signal line driving circuit and a scanning signal line driving circuit.
Figure 22:
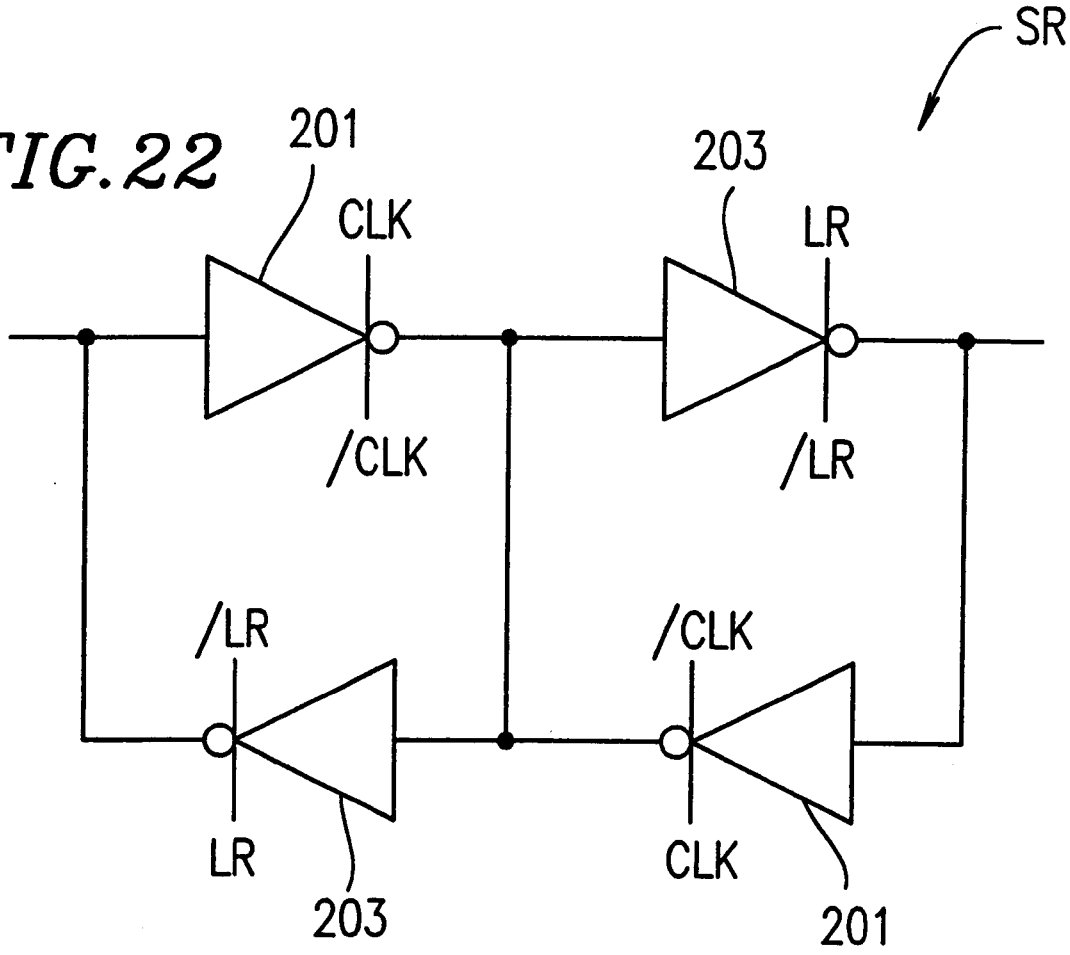
FIG. 22 is a circuit diagram showing another exemplary structure of a shift register used in a data signal line driving circuit and a scanning signal line driving circuit.
Figure 23:
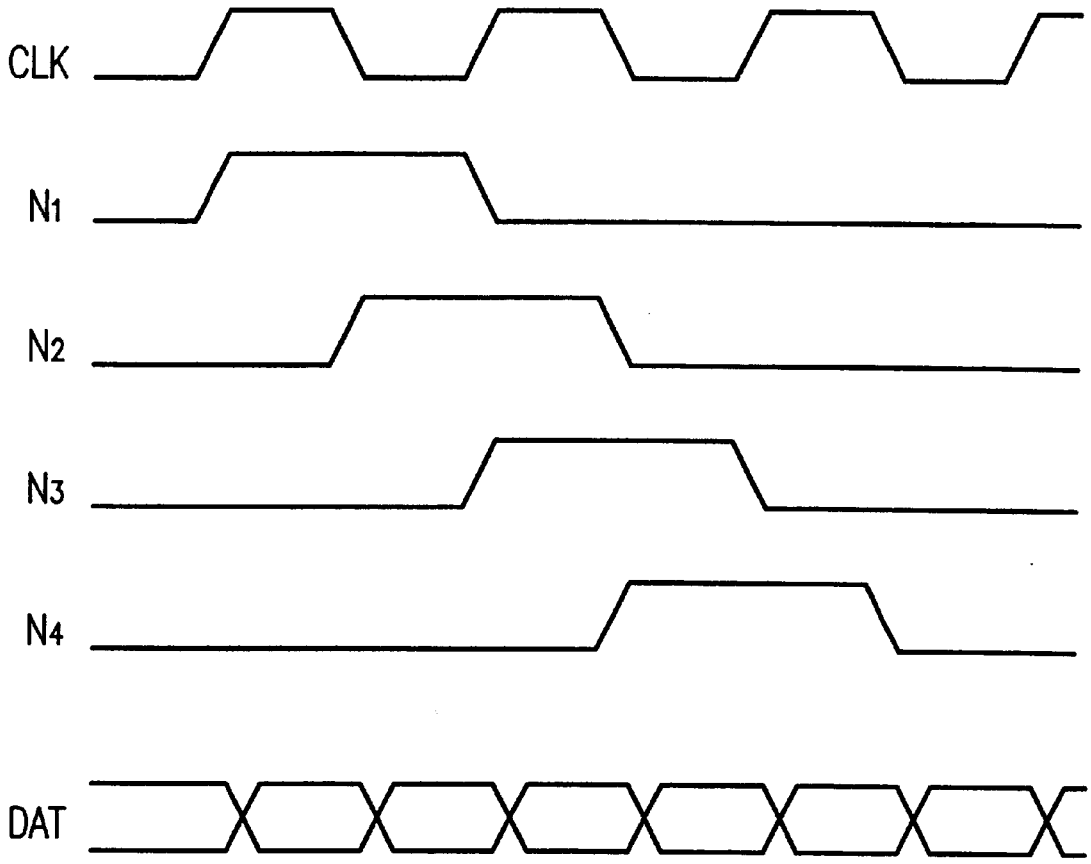
FIG. 23 is a diagram showing exemplary signal waveforms in the data signal line driving circuit shown in FIG. 19.
Figure 24:
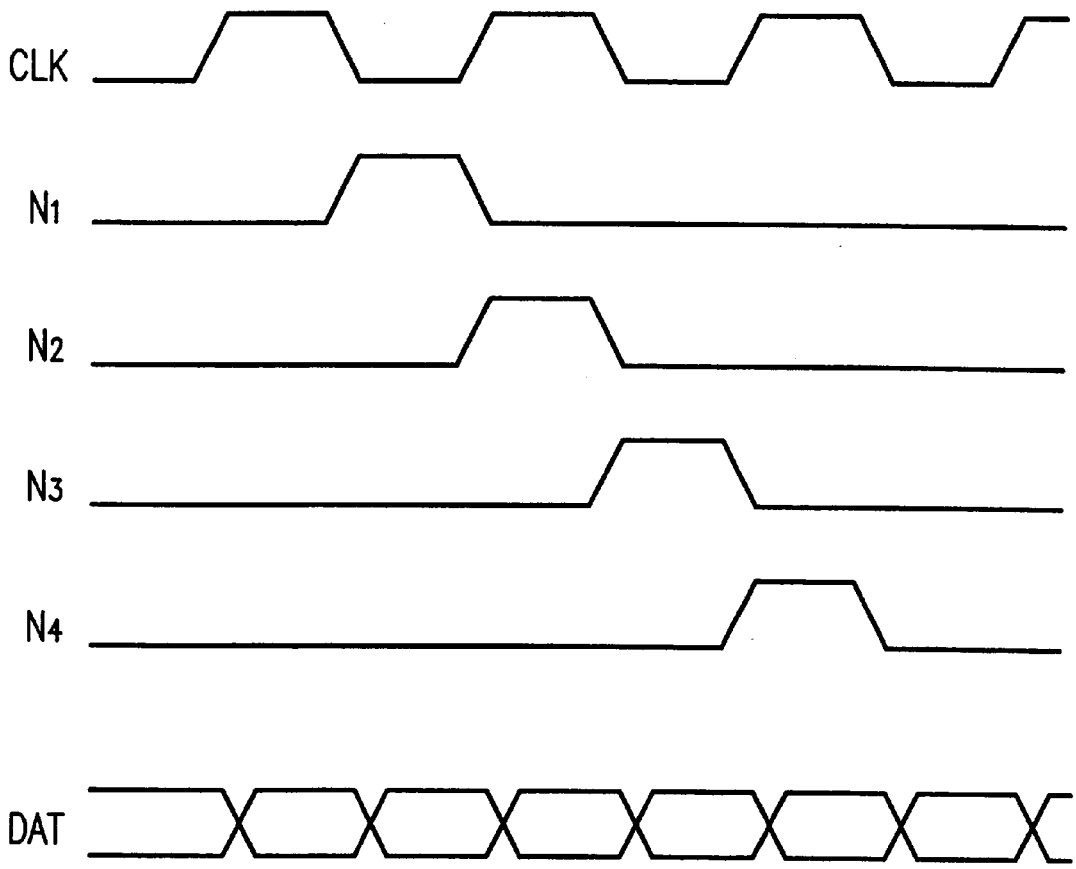
FIG. 24 is a diagram showing exemplary signal waveforms in the data signal line driving circuit shown in FIG. 20.
Figure 25:
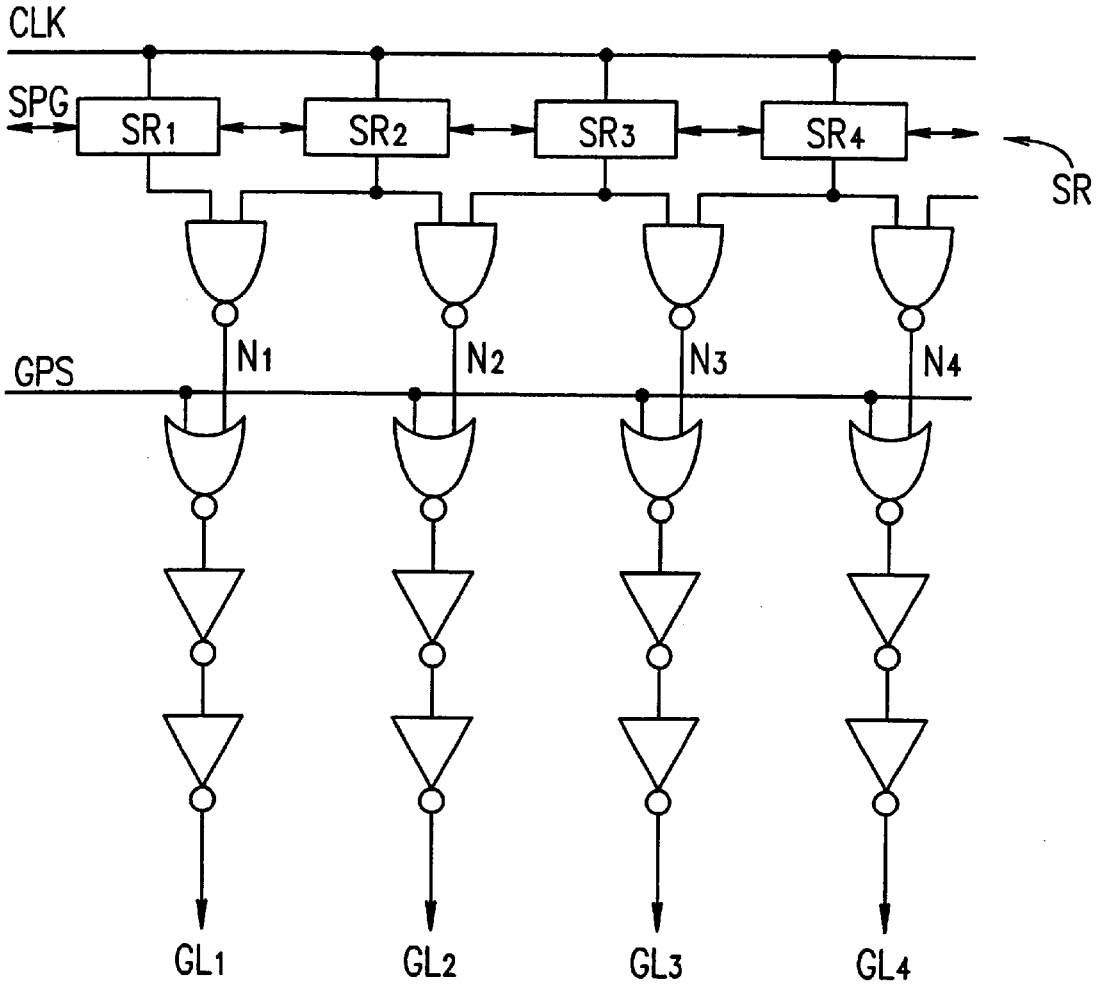
FIG. 25 is a circuit diagram showing another exemplary structure of a conventional data signal line driving circuit.
Figure 26:
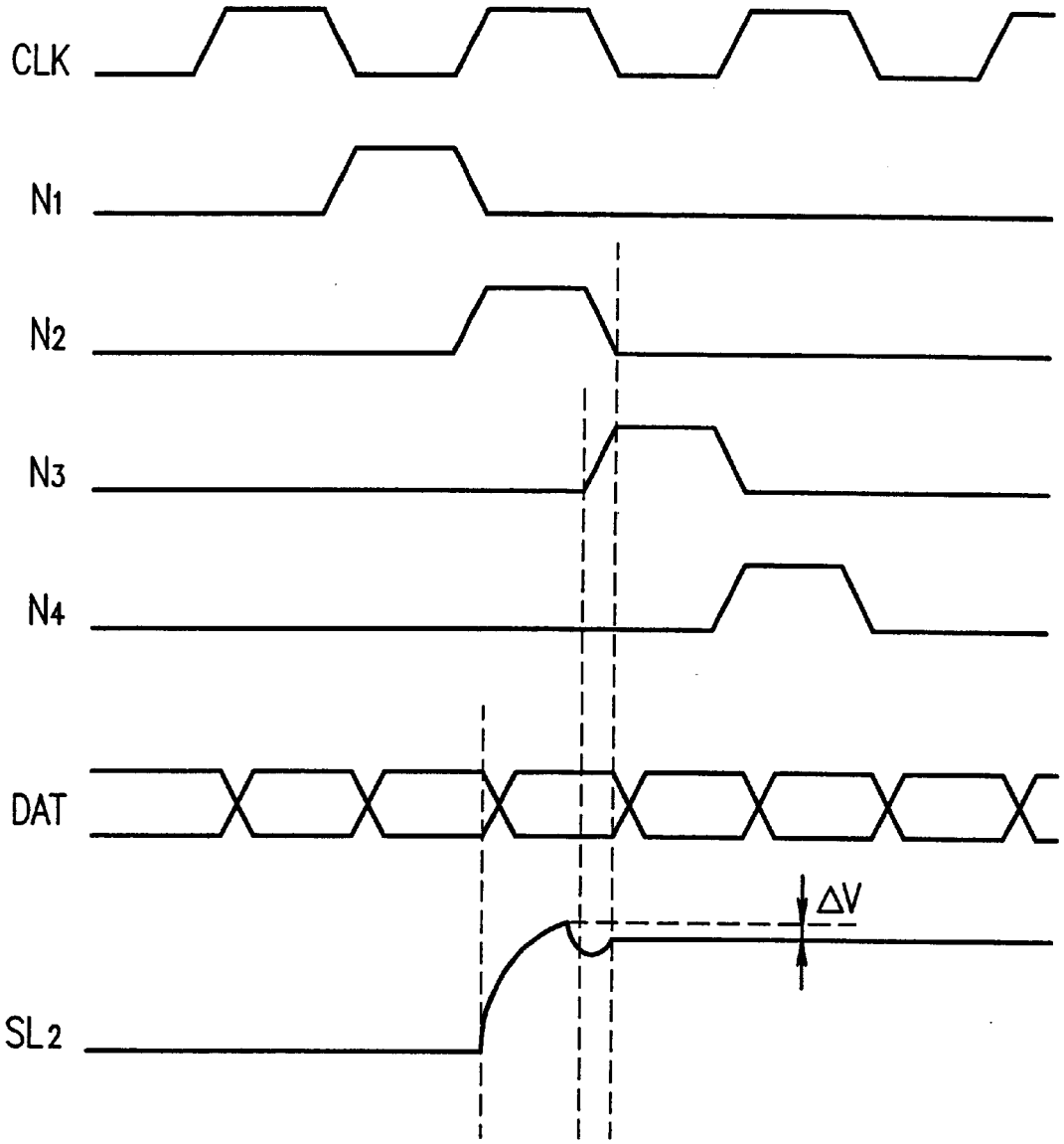
FIG. 26 is a diagram showing other exemplary signal waveforms in the data signal line driving circuit shown in FIG. 20.
Figure 27:
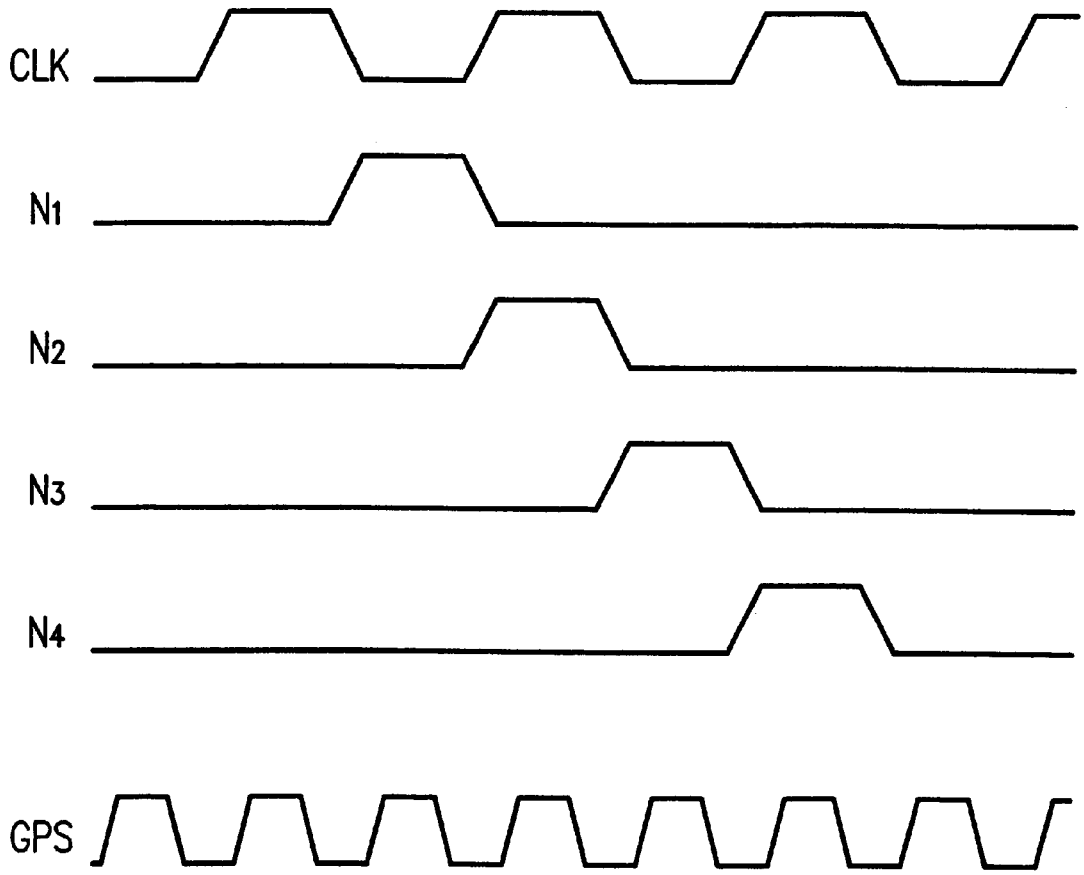
FIG. 27 is a diagram showing exemplary signal waveforms in the data signal line driving circuit shown in FIG. 25.

7, the shift register SR includes arranged registers $SR_1$, $SR_2$, . . . , and sequentially outputs pulses $S_1$, $S_2$, $S_3$, and $S_4$ from each register, while shifting pulses in synchronization with a clock signal CLK (corresponding to the clock signal $CLK_s$ in FIG. 1). An internal structure of the shift register SR includes a plurality of unit circuits shown in either FIG. 21 or 22. A shift register including a plurality of unit circuits shown in FIG. 21 shifts pulses only in one direction, and a shift register including a plurality of unit circuits shown in FIG. 22 shifts pulses in both directions.

In the buffer BUF, the buffer circuits shown in FIG. 4A are arranged. Each buffer circuit generates each of sampling pulses $N_1$, $N_2$, $N_3$, and $N_4$ which have a pulse width smaller than that of each of pulses $S_1$, $S_2$, $S_3$, and $S_4$ from the shift register SR.

A sampling circuit ASW has a plurality of analog switches, $G_1$, $G_2$, $G_3$, and $G_4$, each composed of a pair of transistors. Each of the analog switches $G_1$, $G_2$, $G_3$, and $G_4$ is sequentially turned on in response to each of the sampling pulses $N_1$, $N_2$, $N_3$, and $N_4$, sequentially samples a video signal DAT, and sequentially outputs each sampled video signal to each of data signal lines $SL_1$, $SL_2$, $SL_3$, and $SL_4$.

Figure 8:
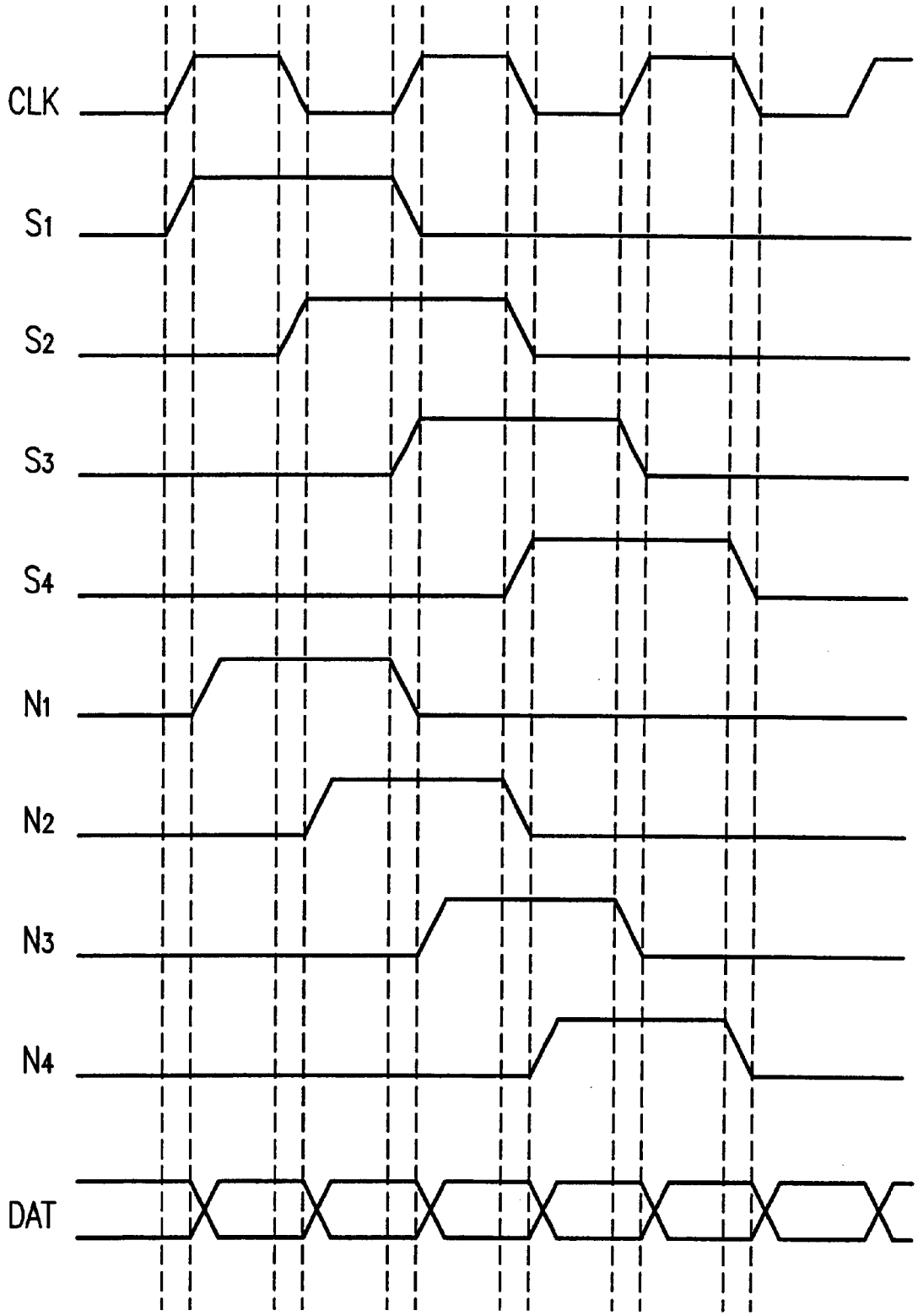
FIG. 8 is a diagram showing exemplary signal waveforms in the data signal line driving circuit shown in FIG. 7.

In such a structure, as shown in FIG. 8, each of the sampling pulses $N_1$, $N_2$, $N_3$, and $N_4$ which have a pulse width smaller than that of each of the pulses $S_1$, $S_2$, $S_3$, and $S_4$ from the shift register SR is generated, so that, for example, the sampling pulses $N_2$ and $N_4$ do not overlap each other. Therefore, for example, when a video signal is output from the data signal line $SL_2$ in response to the sampling pulse $N_2$, and then, a video signal is output to the data signal line $SL_4$ in response to the sampling pulse $N_4$, a video signal to be output to the data signal line $SL_2$ is prevented from fluctuating by being drawn to the data signal line $SL_4$, and a video signal at a desired voltage level can be output to a data signal line.

The buffer shown in FIG. 4A is used as a precondition that an output pulse of the shift register SR is a positive logic. In the case where the output pulse of the shift register SR is a negative logic, the buffer shown in either FIG. 5A, 6A, or 6B can be used.

Figure 9:
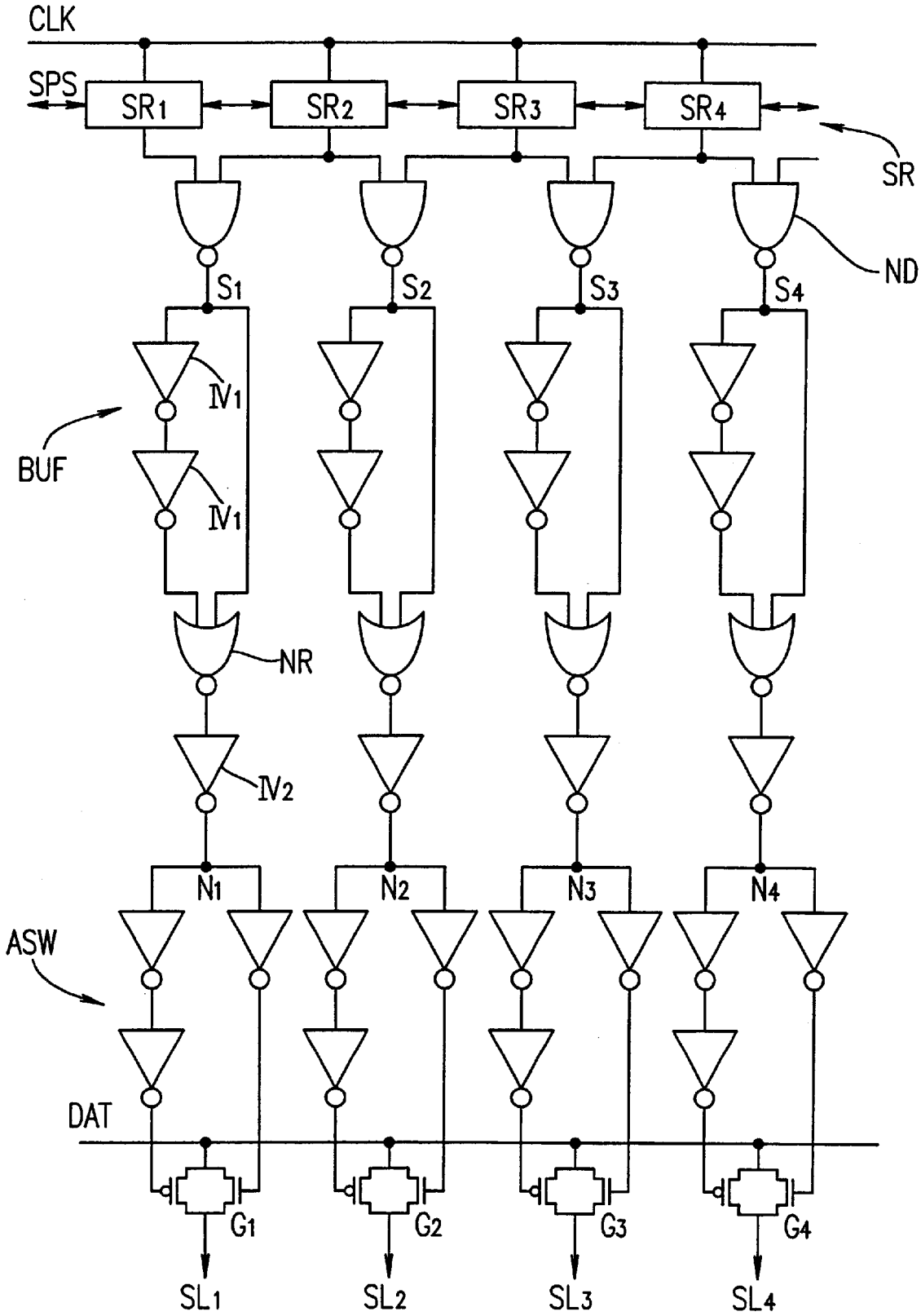
FIG. 9 is a block diagram showing another detailed structure of the data signal line driving circuit shown in FIG. 1.

FIG. 9 is a block diagram showing another detailed structure of the data signal line driving circuit shown in FIG. 1. In FIG. 9, a shift register SR includes arranged registers $SR_1$, $SR_2$, . . . , and sequentially outputs pulses $S_1$, $S_2$, $S_3$, and $S_4$ from each register, while shifting pulses in synchronization with a clock signal CLK (corresponding to the clock signal $CLK_s$ in FIG. 1).

Each NAND circuit ND obtains a NAND between adjacent pulses (i.e., an overlapped portion of adjacent pulses), and outputs each NAND as each of pulses $S_1$, $S_2$, $S_3$, and $S_4$.

Each width of the pulses $S_1$, $S_2$, $S_3$, and $S_4$ shown in FIG. 9 is a half of that of the pulses $S_1$, $S_2$, $S_3$, and $S_4$ shown in FIG. 8.

In the buffer BUF, buffer circuits each including two-staged inverters $IV_1$, a NOR circuit NR, and an inverter $IV_2$ are arranged. In each buffer circuit, the NOR circuit NR generates a NOR signal between a pulse from the NAND circuit ND and adelay signal obtained by delaying the pulse from the NAND circuit ND through the two-staged inverters $IV_1$, and outputs the NOR signal through an inverter $IV_2$. Thus, each buffer circuit sequentially outputs each of sampling pulses $N_1$, $N_2$, $N_3$, and $N_4$ which have a pulse width smaller than that of each of the pulses $S_1$, $S_2$, $S_3$, and $S_4$ and which do not overlap each other.

The sampling circuit ASW has a plurality of analog switches, $G_1$, $G_2$, $G_3$, and $G_4$, each composed of a pair of transistors. Each of the analog switches $G_1$, $G_2$, $G_3$, and $G_4$ is sequentially turned on in response to each of the sampling pulses $N_1$, $N_2$, $N_3$, and $N_4$, sequentially samples a video signal DAT, and sequentially outputs each sampled video signal to each of data signal lines $SL_1$, $SL_2$, $SL_3$, and $SL_4$.

Figure 10:
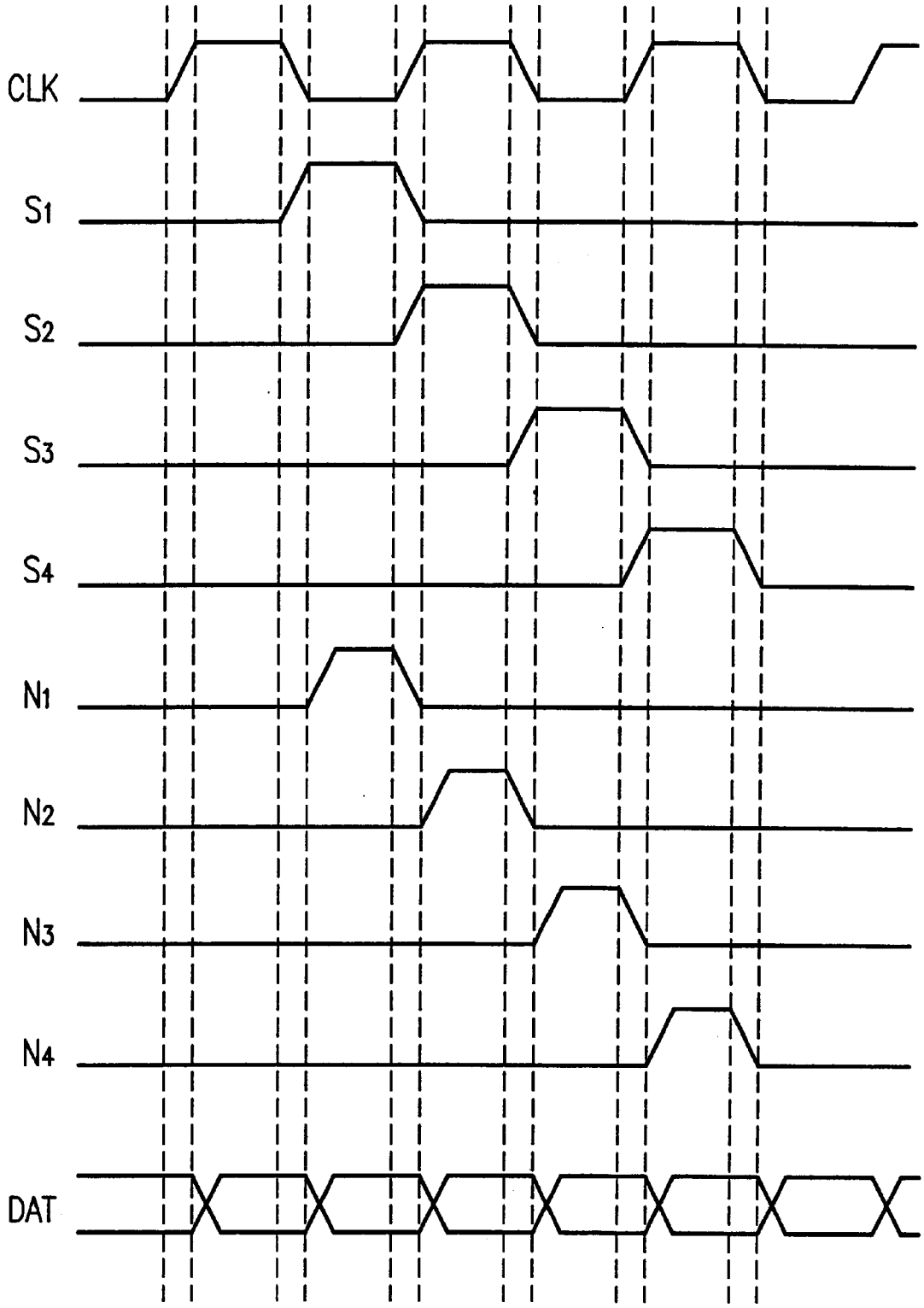
FIG. 10 is a diagram showing exemplary signal waveforms in the data signal line driving circuit shown in FIG. 9.

In such a structure, as shown in FIG. 10, each of the sampling pulses $N_1$, $N_2$, $N_3$, and $N_4$, which have a pulse width smaller than that of each of the pulses $SL_1$, $S_2$, $S_3$, and $S_4$ from the shift register SR and which do not overlap each other, is generated, so that adjacent sampling pulses do not overlap each other. Therefore, for example, when a video signal is output from the data signal line $SL_2$ in response to the sampling pulse $N_2$, and then, a video signal is output to the data signal line $SL_3$ in response to the sampling pulse $N_3$, a video signal to be output to the data signal line $SL_2$ is prevented from fluctuating by being drawn to the data signal line $SL_3$, and a video signal at a desired voltage level can be output to a data signal line.

Embodiment 2

Figure 11:
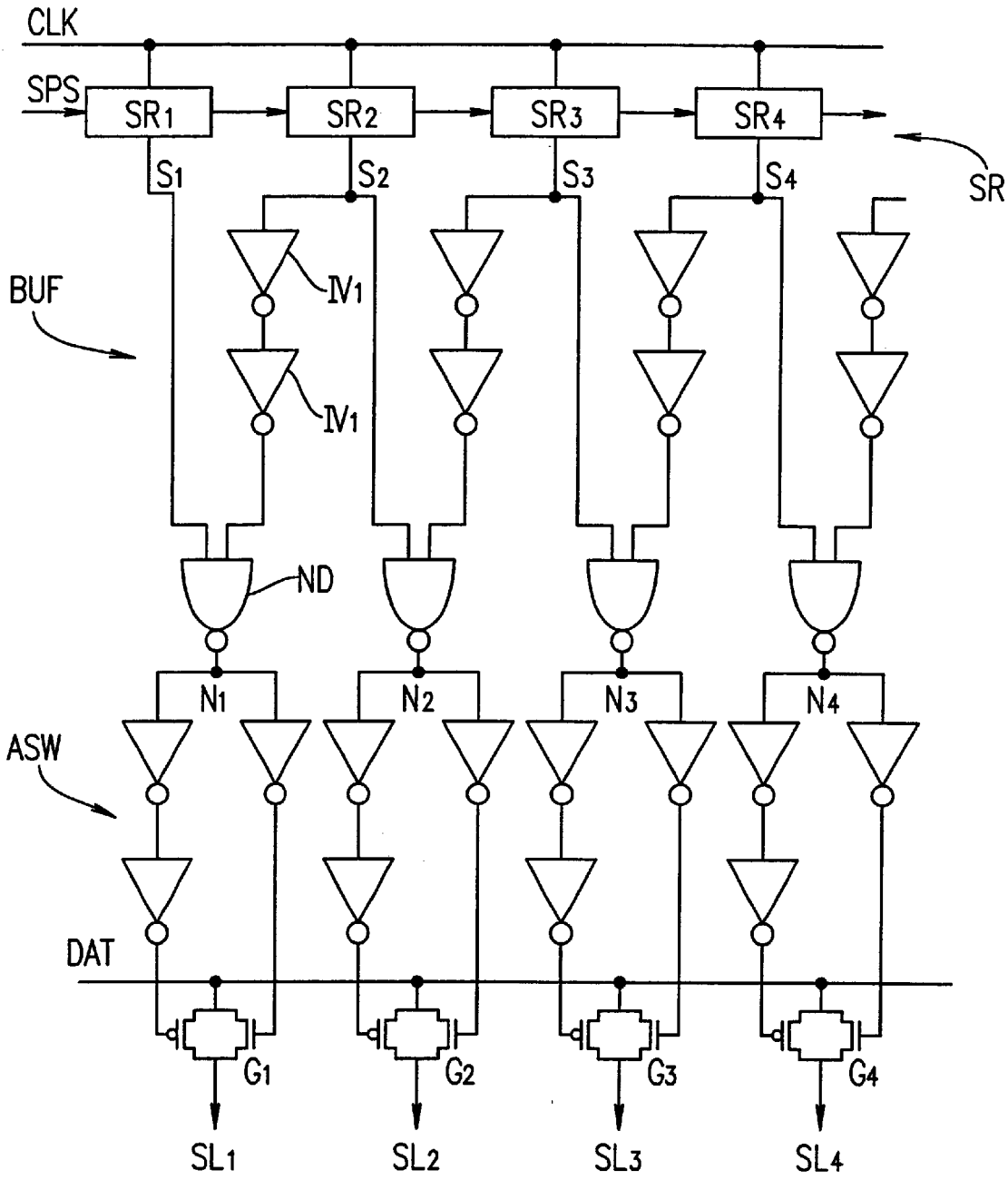
FIG. 11 is a block diagram showing a data signal line driving circuit in Embodiment 2 of the present invention.
Figure 12:
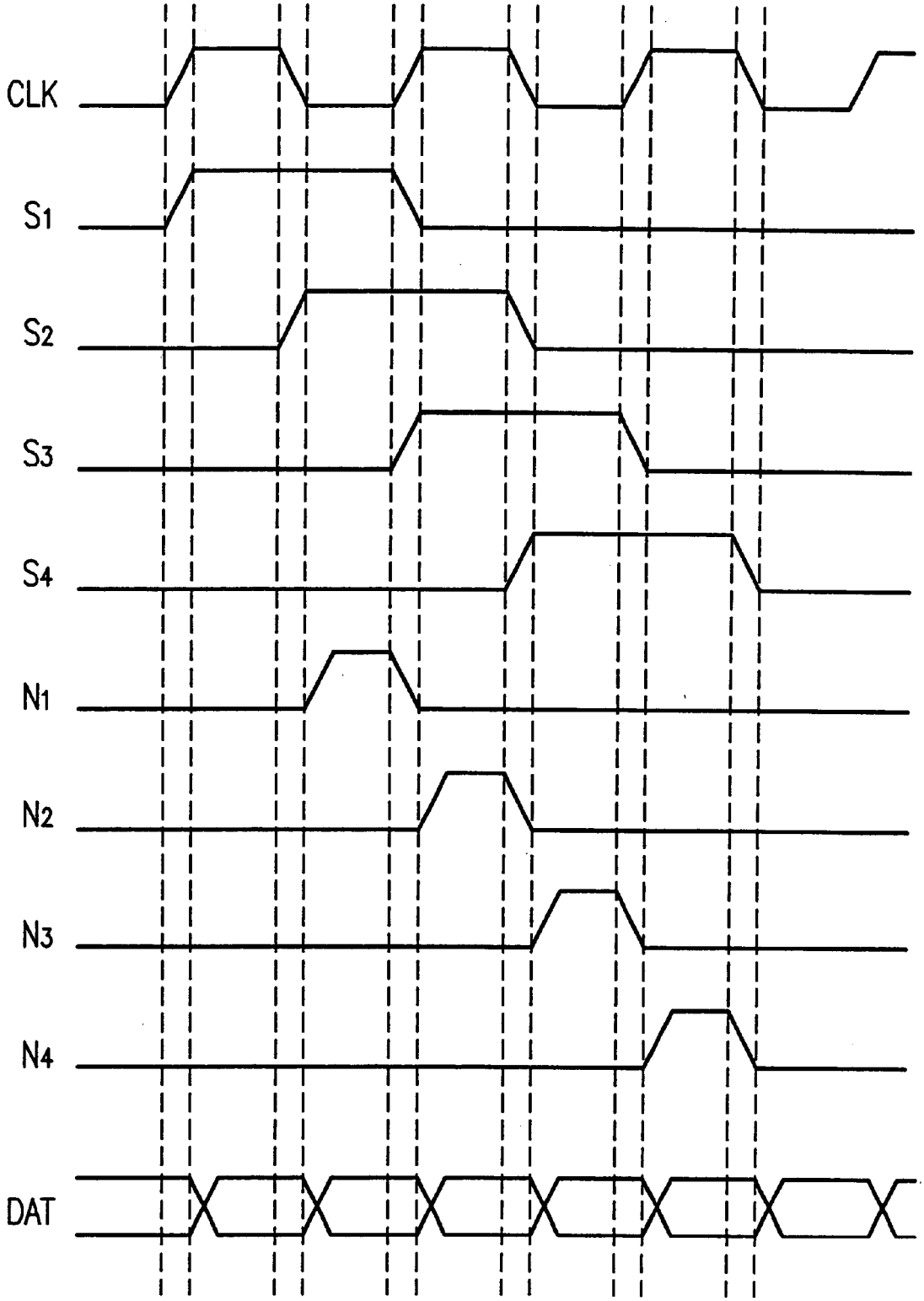
FIG. 12 is a diagram showing exemplary signal waveforms in the data signal line driving circuit shown in FIG. 11.

FIG. 11 is a block diagram showing a data signal line driving circuit in Embodiment 2 of the present invention. FIG. 12 shows waveforms of signals in the data signal line driving circuit in the present embodiment.

In FIG. 11, a shift register SR includes arranged registers $SR_1$, $SR_2$, . . . , and sequentially outputs pulses $S_1$, $S_2$, $S_3$, and $S_4$ from each register, while shifting pulses in synchronization with a clock signal CLK (corresponding to the clock signal $CLK_s$ in FIG. 1). An internal structure of the shift register SR includes a plurality of unit circuits shown in FIG. 21, and pulses are shifted only in one direction.

In a buffer BUF, buffer circuits each including two-staged inverters $IV_1$ and a NAND circuit ND are arranged. Each buffer circuit receives each pulse from adjacent registers, and the NAND circuit ND generates and outputs a NAND signal between one pulse and the other pulse delayed trough two-staged inverters $IV_1$. Thus, each of sampling pulses $N_1$, $N_2$, $N_3$, and $N_4$ is sequentially output, which have a pulse width smaller than that of each of pulses $S_1$, $S_2$, $S_3$, and $S_4$ from the shift register SR and which do not overlap each other.

Each width of the sampling pulses $N_1$, $N_2$, $N_3$, and $N_4$ is a half of the sampling pulses $N_1$, $N_2$, $N_3$, and $N_4$ shown in FIG. 8.

A sampling circuit ASW has a plurality of analog switches $G_1$, $G_2$, $G_3$, and $G_4$ composed of transistors. Each of the analog switches $G_1$, $G_2$, $G_3$, and $G_4$ is sequentially turned on in response to each of the sampling pulses $N_1$, $N_2$, $N_3$, and $N_4$, sequentially samples a video signal DAT, and sequentially outputs each sampled video signal to each of data signal lines $SL_1$, $SL_2$, $SL_3$, and $SL_4$.

In such a structure, as shown in FIG. 12, each of the sampling pulses $N_1$, $N_2$, $N_3$, and $N_4$, which have a pulse width smaller than that of each of the pulses $S_1$, $S_2$, $S_3$, and $S_4$ from the shift register SR, is generated, so that adjacent sampling pulses do not overlap each other. Therefore, a video signal to be output to one data signal line is prevented from fluctuating by being drawn to another data signal line, and a video signal at a desired voltage level can be output to a data signal line.

Figure 13:
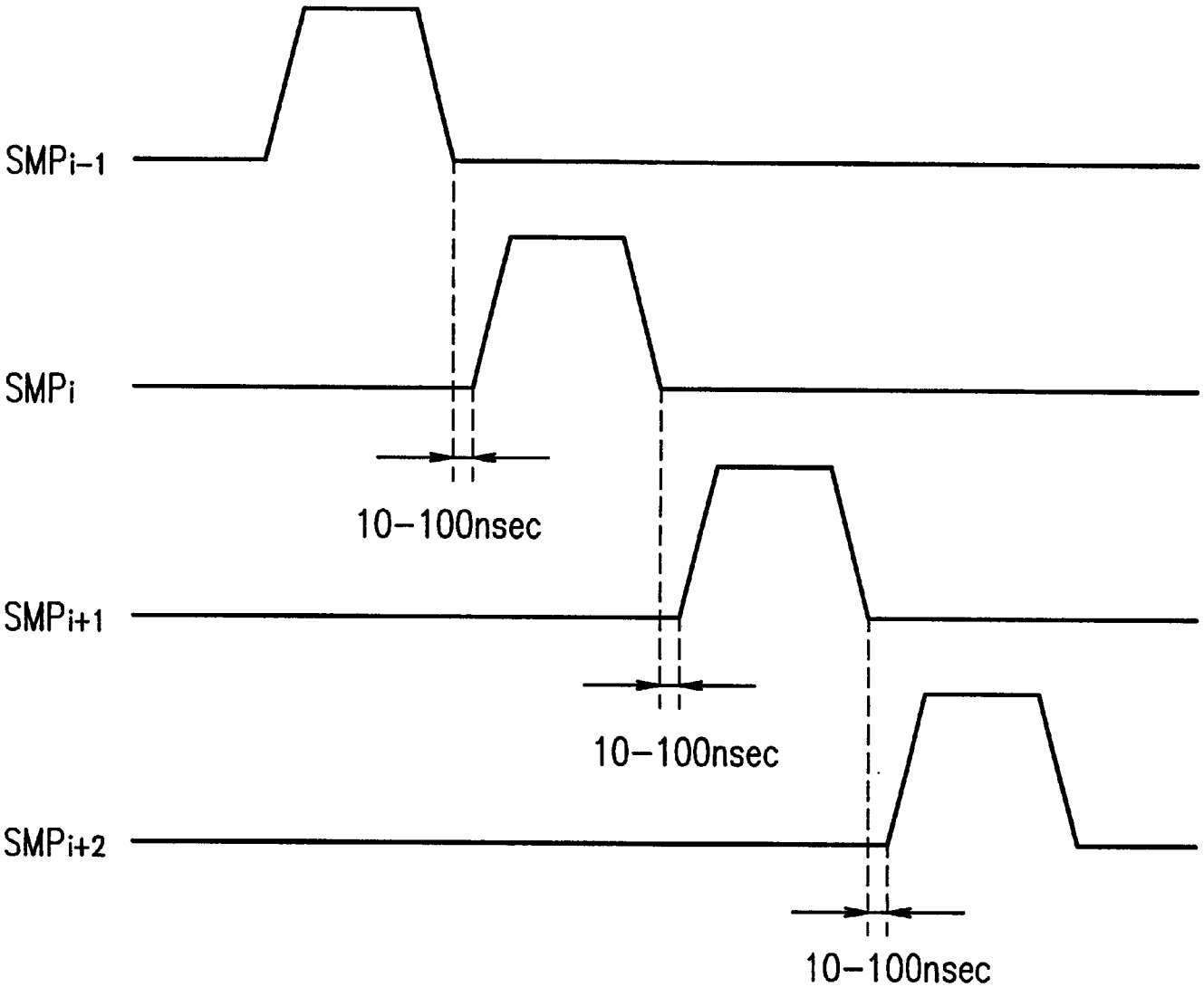
FIG. 13 is a diagram showing an example of signal waveforms in a data signal line driving circuit according to the present invention.

FIG. 13 shows an example of waveforms of sampling pulses in the data signal line driving circuit of the present invention.

In FIG. 13, an interval of about 10 to 100 nsec is provided between sampling pulses of adjacent blocks (columns) (e.g., between sampling pulses $SMP_{i-1}$ and $SNP_i$).

A rising time of a timing signal (e.g., a clock signal) is about 10 to 30 nsec. A phase difference between a clock signal and an inverted signal thereof is about 10 to 30 nsec.

Thus, if an interval between two sampling pulses is set to be about 10 to 100 nsec, even when there is a variation in characteristics of transistors included in a driving circuit, and a waveform of each signal is disturbed due to noise and the like inside or outside of the driving circuit, sampling pulses which do not overlap each other can be generated. Furthermore, a video signal at a desired voltage level can be output to a data signal line.

Figure 17:
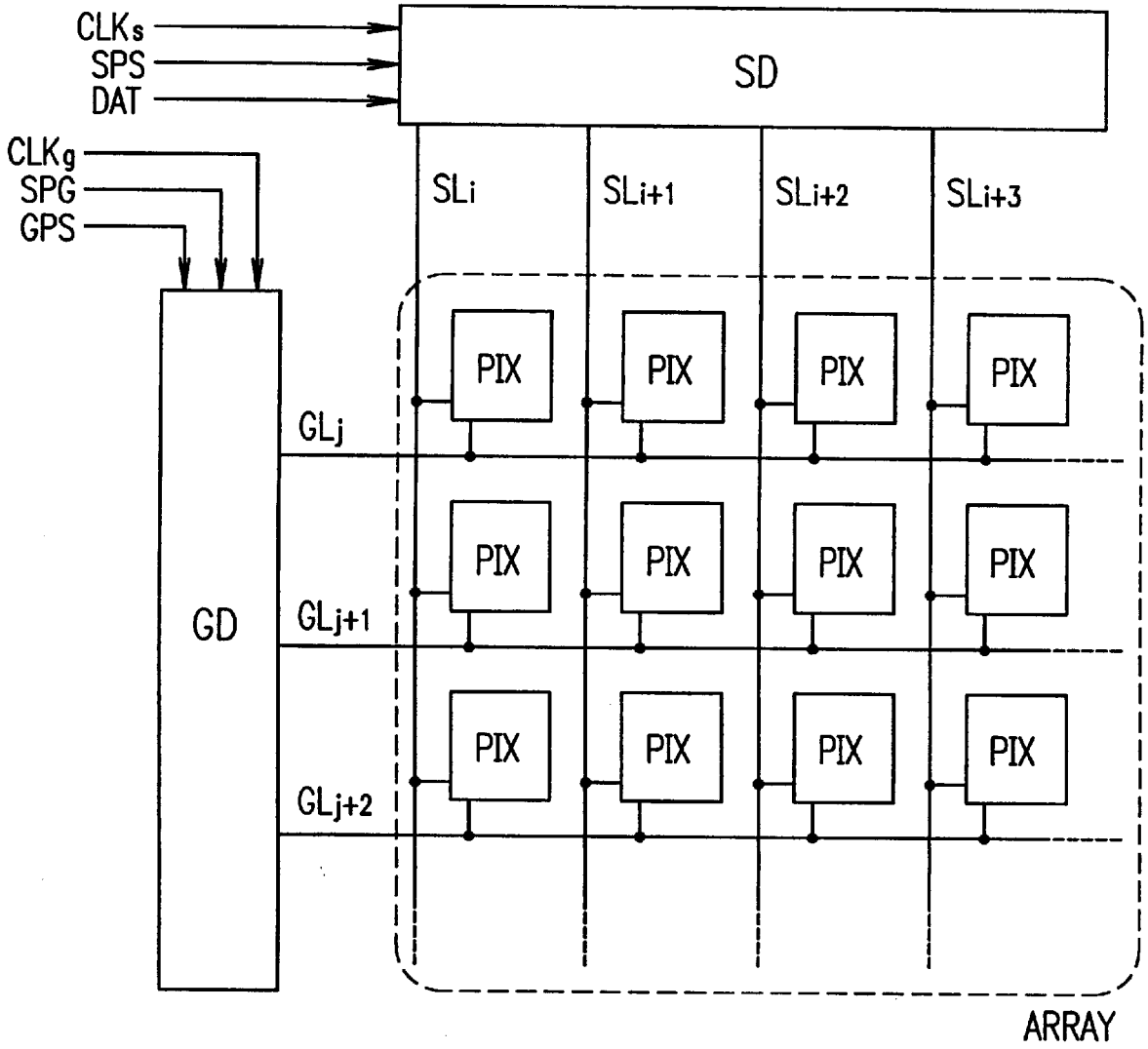
FIG. 17 is a block diagram illustrating a structure of a conventional image display apparatus.
Figure 18:
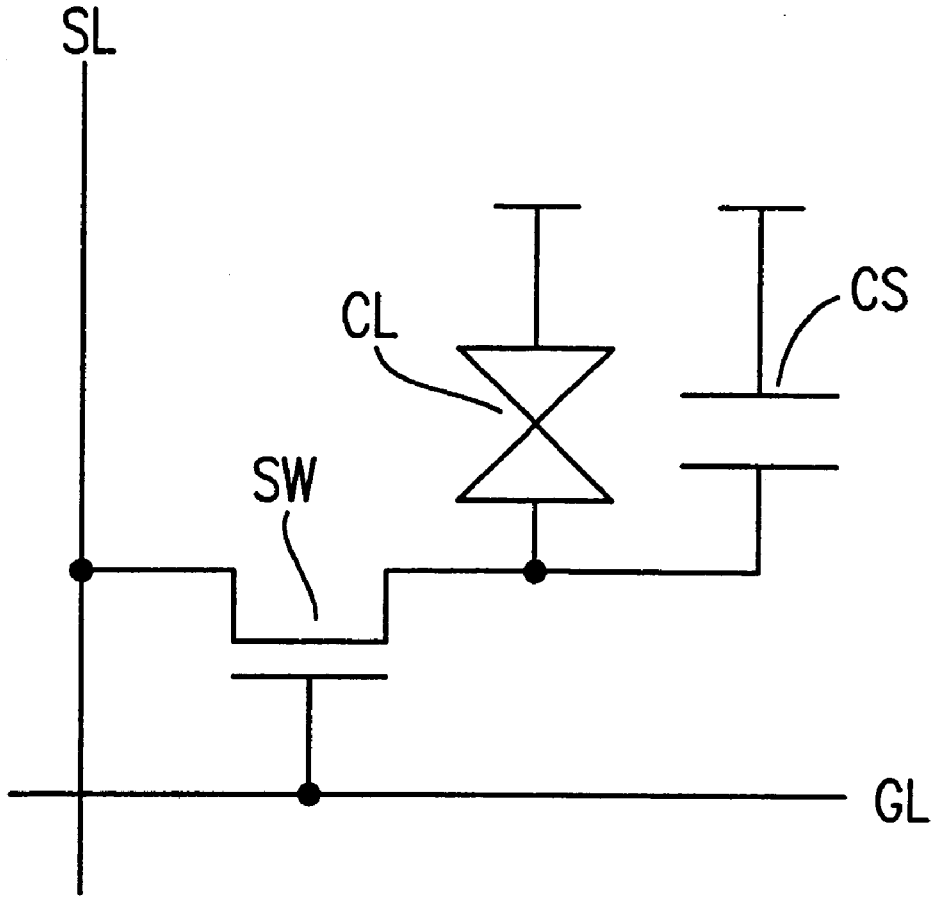
FIG. 18 is a diagram illustrating an internal structure of a pixel in the image display apparatus shown in FIG. 17.
Figure 19:
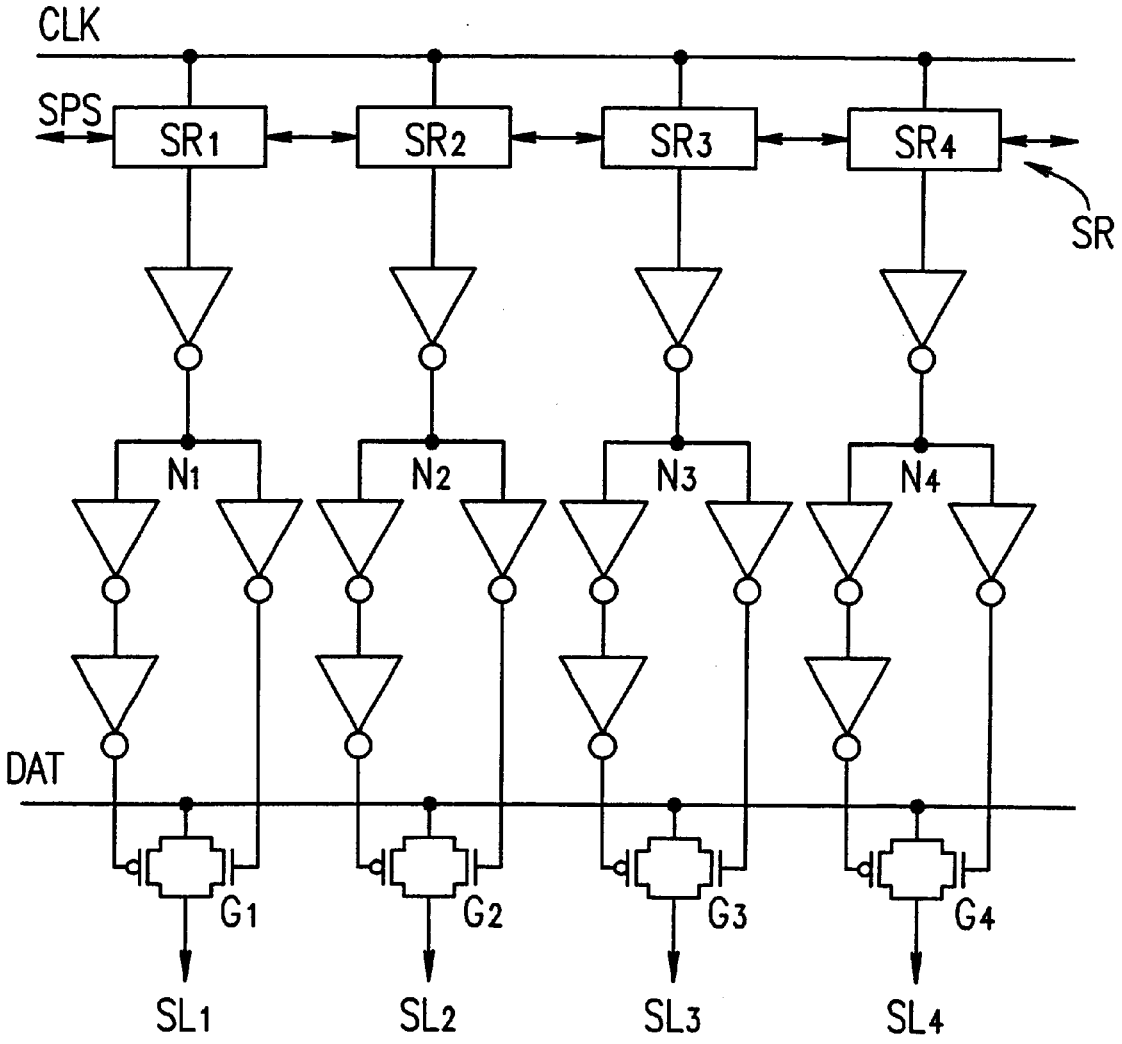
FIG. 19 is a circuit diagram showing an exemplary structure of a conventional data signal line driving circuit.
Figure 20:
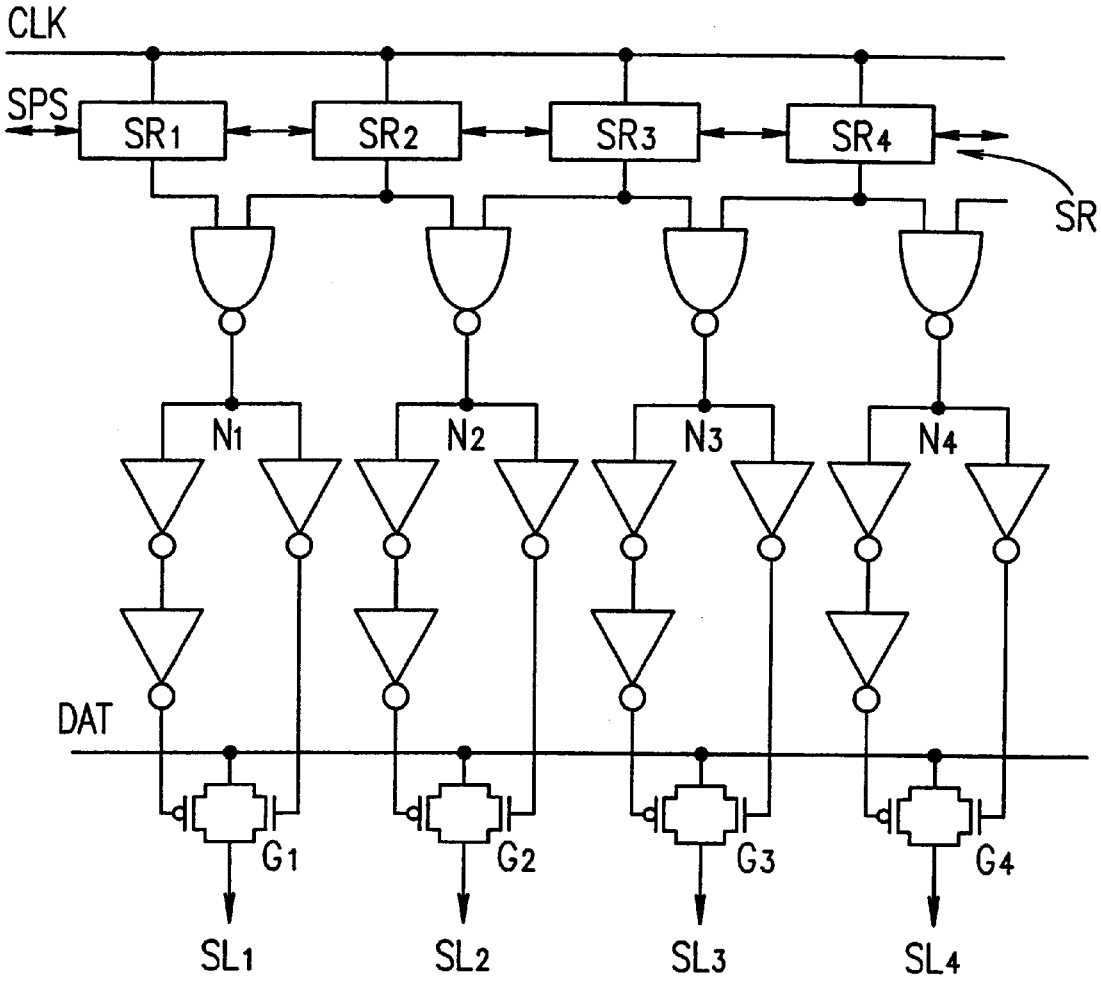
FIG. 20 is a circuit diagram showing another exemplary structure of a conventional data signal line driving circuit.

Each of the data signal line driving circuits described in each Embodiment is applicable to a data signal line driving circuit SD in a liquid crystal display apparatus shown in FIG. 17, and a video signal at a desired voltage level can be output to each data signal line. Thus, a desired voltage is exactly applied to each pixel electrode which contributes to a display, and an image display apparatus having outstanding display quality can be provided.

Embodiment 3

Figure 14:
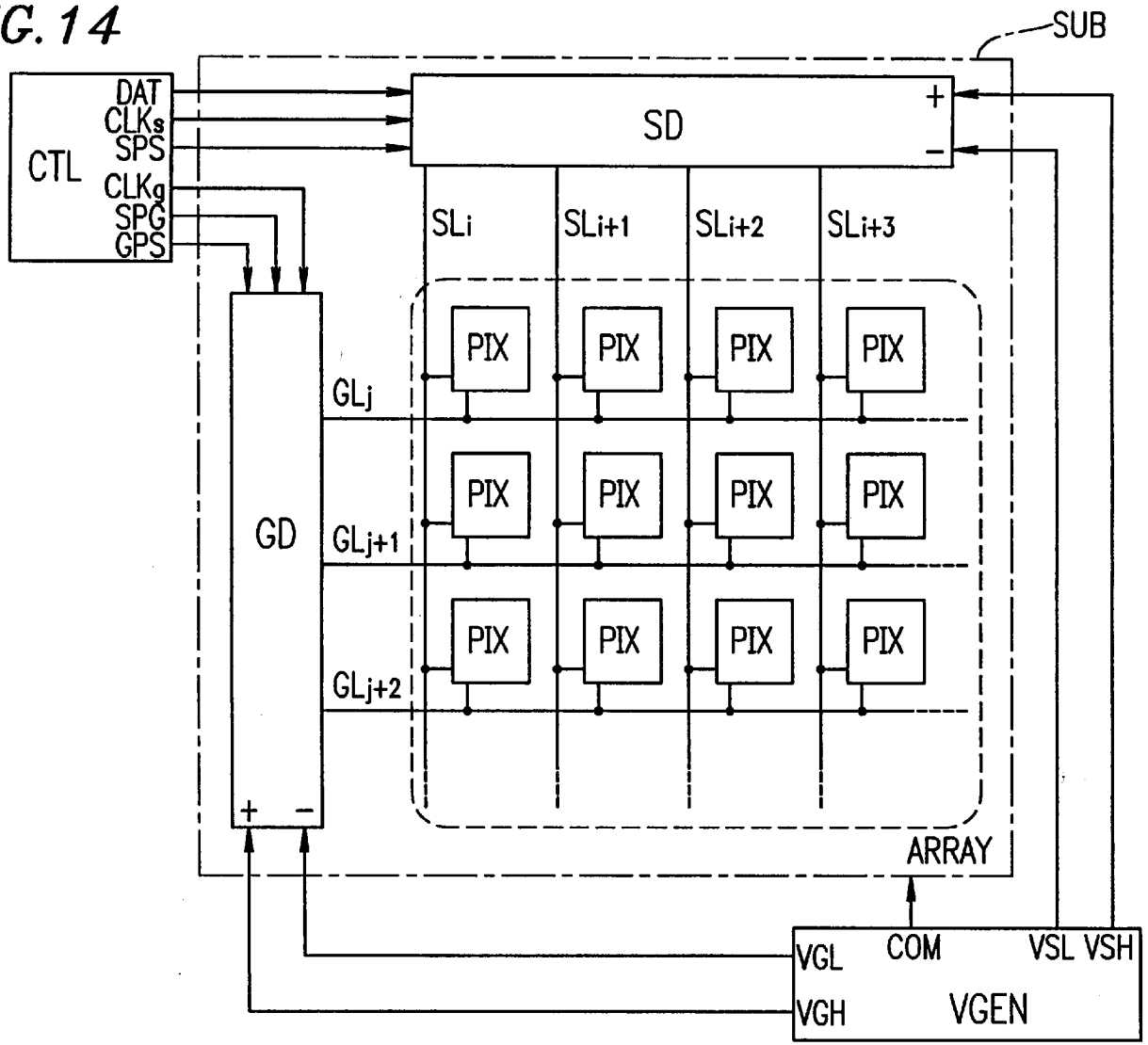
FIG. 14 is a block diagram showing an image display apparatus in Embodiment 3 of the present invention.

FIG. 14 is a block diagram showing an image display apparatus in Embodiment 3 of the present invention.

An image display apparatus in the present embodiment has a driver monolithic structure in which pixels PIX, a data signal line driving circuit SD, and a scanning signal line driving circuit GD on the same substrate SUB, and is driven with a signal from an external control circuit CTL and a driving power source signal from an external power source circuit VGEN.

Either of the data signal line driving circuits described in the above-mentioned embodiments is used as the data signal line driving circuit SD.

In such a structure, the data signal line driving circuit SD is disposed in a large area which is substantially the same as that of a screen (display region), so that transistor characteristics may vary greatly. Furthermore, each length of an interconnect layer also becomes very large, so that the effect of noise between interconnect layers is considered to be large. Thus, in order to enhance display quality, it is required to avoid variation in transistor characteristics and the effect of noise between interconnect layers. Therefore, in the data signal line driving circuit SD, it is desirable that predetermined sampling pulses are prevented from overlapping each other, a video signal on a data signal line is prevented from being drawn to another data signal line, and the video signal is prevented from fluctuating.

Furthermore, by forming the data signal line driving circuit SD and the scanning signal line driving circuit GD on the same substrate with pixels (monolithic structure), production cost and mounting cost of a driving circuit can be reduced, and reliability can be enhanced, compared with the case where these circuits are separately mounted.

Figure 15:
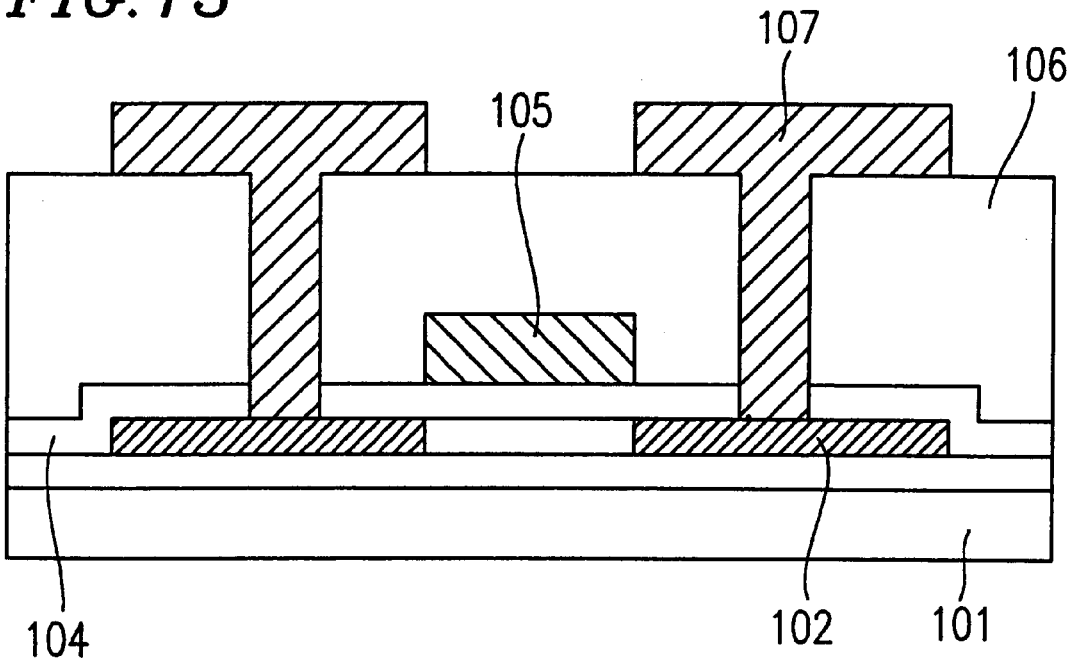
FIG. 15 is a diagram illustrating a structure of a polycrystalline silicon thin film transistor used in the image display apparatus in FIG. 14.

FIG. 15 is a diagram showing a structure of a polycrystalline silicon thin film transistor used in the image display apparatus in FIG. 14.

The polycrystalline silicon thin film transistor shown in FIG. 15 has a stagger (top-gate) structure in which a polycrystalline silicon thin film 102 on an insulating substrate 101 is used as an active layer. The present invention is not limited thereto however, and another structure such as a reverse stagger structure may, be used.

By using the above-mentioned polycrystalline silicon thin film transistor, a scanning signal driving circuit and a data signal line driving circuit having a practical driving ability can be formed on an identical substrate with a pixel array during substantially the same production step.

Furthermore, the polycrystalline silicon thin film transistor has quite a large variation in characteristics, compared with a single crystal silicon transistor (MOS transistor). Therefore, it is desirable that predetermined sampling pulses are prevented from overlapping each other, a video signal on a data signal line is prevented from being drawn to another data signal line, and the video signal is prevented from being fluctuated.

FIGS. 16A to 16K are cross-sectional views of the polycrystalline silicon thin film transistor shown in FIG. 15 during each step.

Hereinafter, a production process for forming a polycrystalline silicon thin film transistor at about 600° C. or lower will be briefly described.

Figure 16A:
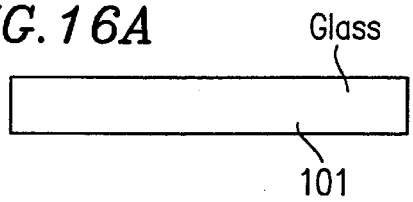
FIGS. 16A through 16K show production steps of the polycrystalline silicon thin film transistor shown in FIG. 15.
Figure 16B:
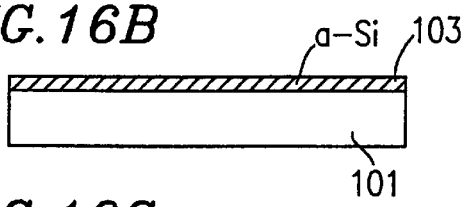
Figure 16C:
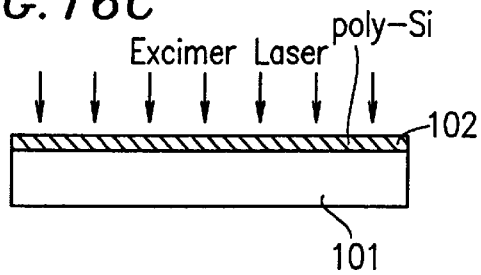

As shown in FIGS. 16A and 16B, first, an amorphous silicon thin film 103 is formed on an insulating substrate (glass substrate) 101. As shown in FIG. 16C, the amorphous silicon thin film 103 is irradiated with excimer laser, whereby a polycrystalline silicon thin film 102 is formed.

Figure 16D:
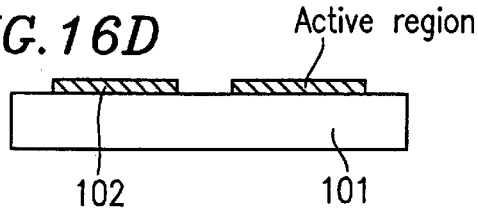
Figure 16E:
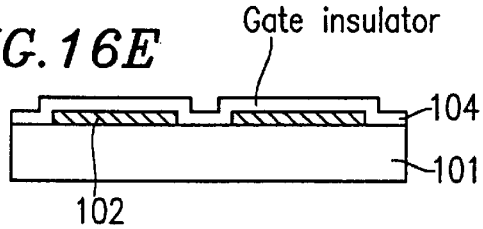

Next, as shown in FIG. 16D, the polycrystalline silicon thin film 102 is patterned to a desired shape. As shown in FIG. 16E, a gate insulating film 104 made of silicon dioxide is formed on the polycrystalline silicon thin film 102.

Figure 16F:
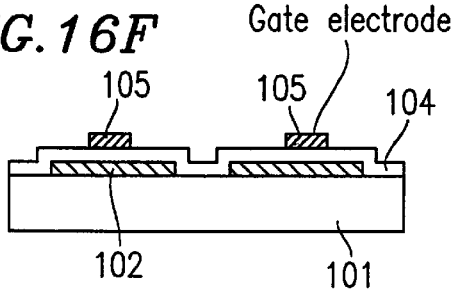
Figure 16G:
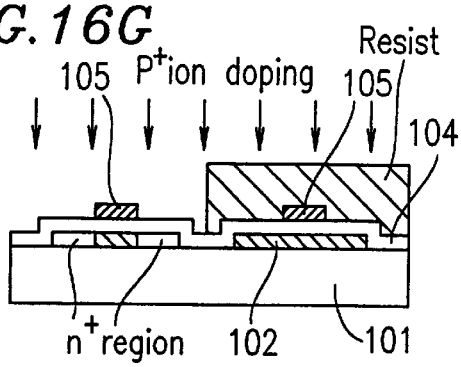
Figure 16H:
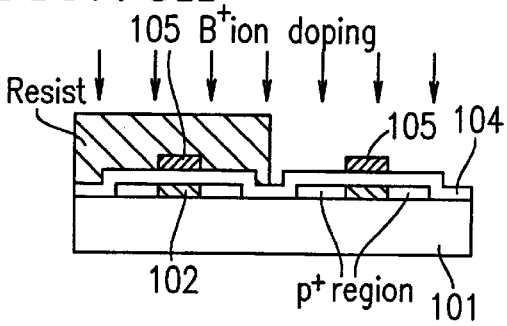
Figure 16I:
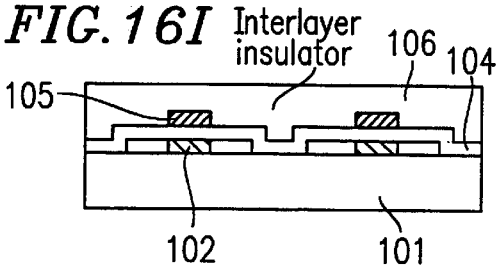

Furthermore as shown in FIG. 16F, gate electrodes 105 of thin film transistors are formed using aluminum or the like. There after, as shown in FIGS. 16G and 16H, impurities (phosphorus for an n-type region, and boron for a p-type region) are implanted into source and drain regions of the thin film transistors.

Figure 16J:
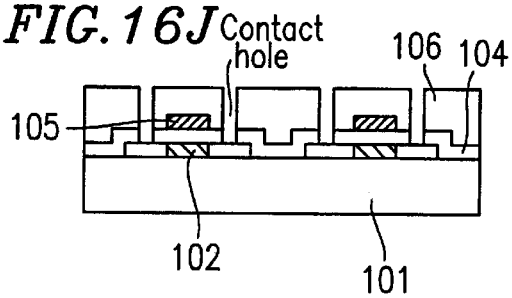
Figure 16K:
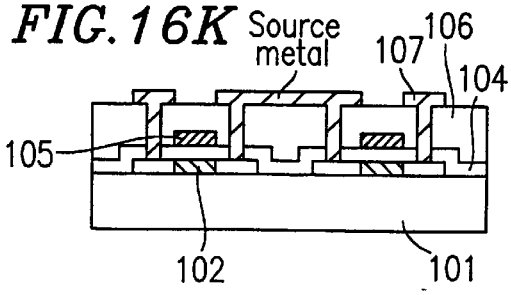

Thereafter, as shown in FIG. 161, an interlayer insulator 106 made of silicon dioxide, silicon nitride or the like is formed. As shown in FIG. 16J, contact holes are formed in the interlayer insulator 106. Thereafter, as shown in FIG. 16K, an interconnect layer 107 made of aluminum or the like is formed.

During the above-mentioned steps, the maximum process temperature is about 600° C. (which is used for forming the gate insulating film), so that glass with high resistance to heat such as 1737 glass available from Corning Co., Ltd. (U.S.) can be used.

In a liquid crystal display apparatus, a transparent electrode (in the case of a transmission type liquid crystal display apparatus), a reflective electrode (in the case of a reflection type liquid crystal display apparatus), and the like will be formed via another interlayer insulator.

In the case where the polycrystalline silicon thin film transistor is formed at about 600° C. or lower depending upon the production steps as shown in FIGS. 16A to 16K, a glass substrate with a large area at a low cost can be, used, which realizes a low cost and a large area for an image display apparatus.

In the data signal line driving circuit of the present invention, a pulse width of a sampling signal is prescribed to be small so that rising and falling of sampling signals for sampling a video data signal do not overlap each other. Therefore, a video signal is output to a data signal line, and then, a video signal is output to the subsequent data signal line. This prevents a video signal on a data signal line from being drawn to another data signal line, and a video signal at a desired voltage level can be output to any data signal line.

Furthermore, the image display apparatus of the present invention is provided with the data signal line driving circuit as described above, so that a signal at desired voltage level can be written to a display electrode, and an image with high display quality can be displayed.

Furthermore, in the case of producing an image display apparatus by forming pixels and a signal line driving circuit on a polycryalline silicon thin film formed on an insulating substrate, a mounting cost of a driving circuit can be reduced, and an image display with high quality can be realized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A data signal line driving circuit which sequentially forms a plurality of sampling signals and continuously samples input signals to output such input signals, in response to the plurality of sampling signals, wherein the sampling signals respectively represent sampling periods thereof which are different from each other, and a pulse width of each of the sampling signals is prescribed to be small so that rising and falling of each of the sampling signals do not overlap each other.

2. A data signal line driving circuit according to claim 1, wherein each of the sampling signals is obtained as a NAND signal or a NOR signal between a pulse signal and a signal obtained by delaying the pulse signal through a plurality of inverter circuits, whereby a pulse width of each of the sampling signals is prescribed to be small.

3. A data signal line driving circuit according to claim 2, wherein a capacitance is connected between the plurality of inverter circuits.

4. A data signal line driving circuit according to claim 2, wherein a capacitance is connected between each of the inverter circuits and either a NAND circuit or a NOR circuit.

5. A data signal line driving circuit according to claim 2, wherein a pulse signal is a pulse output from a shift register.

6. A data signal line driving circuit according to claim, 1, comprising a shift register capable of shifting sampling pulses in both directions or in one direction, wherein each of the sampling signals is obtained by using either a NAND signal or a NOR signal between two adjacent output pulses output from the shift register, and a delay signal of the NAND signal or the NOR signal, whereby the sampling signal of either the NAND signal or the NOR signal, having a decreased pulse width, is obtained.

7. A data signal line driving circuit according to claim 1, comprising a shift register capable of shifting sampling pulses in one direction, wherein each of the sampling signals is obtained as either a NAND signal or a NOR signal between one of two adjacent output pulses output from the shift register and the other pulse which is delayed, whereby a pulse width of each of the sampling signals is decreased.

8. A data signal line driving circuit according to claim 2, wherein a time of the delay is about 10 nsec to about 100 nsec.

9. A data signal line driving circuit according to claim 6, wherein a time of the delay is about 10 nsec to about 100 nsec.

10. A data signal line driving circuit according to claim 7, wherein a time of the delay is about 10 nsec to about 100 nsec.

11. An active matrix type image display apparatus, comprising:

a plurality of data signal lines arranged in a column direction;

a plurality of scanning signal lines arranged in a row direction;

a plurality of pixels arranged in a matrix surrounded by the data signal lines and the scanning signal lines;

a data signal line driving circuit for supplying video data to the data signal lines;

a scanning signal line driving circuit for supplying a scanning signal to the scanning signal lines, and wherein the data signal line driving circuit is a data signal line driving circuit which sequentially forms a plurality of sampling signals and continuously sampling input signals to output them, in response to the sampling signals, wherein the sampling signals respectively represent sampling periods thereof which are different from each other, and a pulse width of each of the sampling signals is prescribed to be small so that rising and falling of each of the sampling signals do not overlap each other.

12. An image display apparatus according to claim 11, wherein the scanning signal line driving circuit and the data signal line driving circuit are formed on the same substrate with the pixels.

13. An image display apparatus according to claim 11, wherein active elements included in the scanning signal line driving circuit, the data signal line driving circuit, and the pixels are polycrystalline silicon thin film transistors.

14. An image display apparatus according to claim 13, wherein the active elements are formed on a glass substrate by a process at about 600° C. or lower.

15. The driving circuit of claim 1, wherein adjacent sampling signals do not overlap each other.

16. An active matrix type image display apparatus, comprising:

a plurality of data signal lines arranged in a column direction;

a plurality of scanning signal lines arranged in a row direction;

a plurality of pixels arranged in a matrix surrounded by the data signal lines and the scanning signal lines;

a data signal line driving circuit for supplying video data to the data signal lines;

a scanning signal line driving circuit for supplying a scanning signal to the scanning signal lines, and wherein the data signal line driving circuit is a data signal line driving circuit which sequentially forms a plurality of sampling signals and continuously sampling input signals to output them, in response to the sampling signals, wherein the sampling signals respectively represent sampling periods thereof which are different from each other, and a pulse width of each of the sampling signals is prescribed to be small so that adjacent sampling signals do not overlap each other.

17. A data signal line driving circuit which sequentially forms a plurality of sampling signals and samples input signals to output such input signals in response to the plurality of sampling signals, the data signal line driving circuit comprising:

at least one buffer that sequentially generates the sampling signals in a manner such that adjacent sampling pulses overlap one another by about half a pulse width and every other sampling signal does not overlap with one another.

18. The circuit of claim 17, wherein rising and falling of each of the sampling signals do not overlap each other.

19. A driving circuit comprising:

a data signal line driving circuit which sequentially forms a plurality of data sampling signals and continuously samples input signals to output such input signals, in response to the plurality of sampling signals, and wherein the data sampling signals respectively represent sampling periods thereof which are different from each other, and a pulse width of each of the data sampling signals is prescribed to be small so that rising and falling of each of the data sampling signals do not overlap each other.

20. An active matrix type display apparatus, comprising:

a plurality of data signal lines arranged in a column direction;

a plurality of scanning signal lines arranged in a row direction;

a plurality of pixels arranged in a matrix surrounded by the data signal lines and the scanning signal lines;

a data signal line driving circuit for supplying video data to the data signal lines;

a scanning signal line driving circuit for supplying a scanning signal to the scanning signal lines, and wherein the data signal line driving circuit is a data signal line driving circuit which sequentially forms a plurality of data sampling signals and continuously sampling input signals to output them, in response to the data sampling signals, wherein the data sampling signals respectively represent sampling periods thereof which are different from each other, and a pulse width of each of the data sampling signals is prescribed to be small so that rising and falling of each of the data sampling signals do not overlap each other.

21. An active matrix type display apparatus, comprising:

a plurality of data signal lines arranged in a column direction;

a plurality of scanning signal lines arranged in a row direction;

a plurality of pixels arranged in a matrix surrounded by the data signal lines and the scanning signal lines;

a data signal line driving circuit for supplying video data to the data signal lines;

a scanning signal line driving circuit for supplying a scanning signal to the scanning signal lines, and wherein the data signal line driving circuit is a data signal line driving circuit which sequentially forms a plurality of data sampling signals and continuously sampling input signals to output them, in response to the data sampling signals, wherein the data sampling signals respectively represent sampling periods thereof which are different from each other, and a pulse width of each of the data sampling signals is prescribed to be small so that adjacent data sampling signals do not overlap each other.

22. A data signal line driving circuit which sequentially forms a plurality of data sampling signals and samples input signals to output such input signals in response to the plurality of sampling signals, the data signal line driving circuit comprising:

at least one buffer that sequentially generates the data sampling signals in a manner such that adjacent data sampling pulses overlap one another by about half a pulse width and every other data sampling signal does not overlap with one another.

23. The driving circuit of claim 1, further comprising a sampling signal generating circuit for outputting the sampling signals which are sent to a sampling switch.

24. The display apparatus of claim 11, further comprising a sampling signal generating circuit for outputting the sampling signals which are sent to a sampling switch.

* * * * *